US010024107B2

(12) United States Patent
Peterson et al.

(10) Patent No.: US 10,024,107 B2
(45) Date of Patent: Jul. 17, 2018

(54) ROTARY DRILL BIT

(71) Applicant: EPIROC DRILLING TOOLS LLC, Fort Loudon, PA (US)

(72) Inventors: Gregory Wayne Peterson, Mesa, AZ (US); Srinidhi Bangalore Gopalakrishna, Bengalura (IN); James Wilson Langford, Granbury, TX (US)

(73) Assignee: EPIROC DRILLING TOOLS LLC, Fort Loudon, PA (US)

( * ) Notice: Subject to any disclaimer, the term of this patent is extended or adjusted under 35 U.S.C. 154(b) by 395 days.

(21) Appl. No.: 14/652,280

(22) PCT Filed: Dec. 14, 2012

(86) PCT No.: PCT/US2012/069722
§ 371 (c)(1),
(2) Date: Jun. 15, 2015

(87) PCT Pub. No.: WO2014/092720
PCT Pub. Date: Jun. 19, 2014

(65) Prior Publication Data
US 2015/0322724 A1 Nov. 12, 2015

(51) Int. Cl.
*E21B 10/22* (2006.01)
*E21B 10/23* (2006.01)

(52) U.S. Cl.
CPC ..... *E21B 10/22* (2013.01); *E21B 10/23* (2013.01)

(58) Field of Classification Search
CPC ..... E21B 10/23; E21B 10/22
See application file for complete search history.

(56) References Cited

U.S. PATENT DOCUMENTS 3,401,758 A * 9/1968 Talbert ..... E21B 10/18 175/318
3,720,274 A * 3/1973 McCallum ..... E21B 10/22 175/372

(Continued)

FOREIGN PATENT DOCUMENTS

CN 101033680 A 9/2007
CN 202131980 U 2/2012

(Continued)

OTHER PUBLICATIONS

Notification of the First Office Action—Apr. 5, 2016 (Issued in Application No. CN 201280078136.3).

(Continued)

*Primary Examiner* — D. Andrews
*Assistant Examiner* — Michael A Goodwin
(74) *Attorney, Agent, or Firm* — Venable LLP; Jeffri A. Kaminski

(57) ABSTRACT

An air-cooled earth-boring drill bit including a plurality of lugs. Each lug includes a pin flange. A first roller race is distal to the pin flange. A thrust flange is distal to the first roller race. At least one pin flange vent slot is arranged in a surface of the pin flange opposite the first roller race. The at least one pin flange vent slot opens in a direction of a load side of a bearing. At least one thrust flange vent slot is arranged in a surface of the thrust flange facing the first rollers. The at least one thrust flange vent slot opens in the direction of the load side of the bearing. A plurality of flow passages are arranged within the lug to supply fluid to the at least one pin flange vent slot and the at least one thrust flange vent slot.

18 Claims, 26 Drawing Sheets

(56) References Cited

U.S. PATENT DOCUMENTS

| | | | | | |
|---|---|---|---|---|---|
| 3,924,695 | A | | 12/1975 | Kennedy | |
| 4,080,091 | A | | 3/1978 | Hollingshead | |
| 4,098,358 | A | | 7/1978 | Klima | |
| 4,136,748 | A | | 1/1979 | Dickerhoff | |
| 4,167,220 | A | * | 9/1979 | Ernst | E21B 10/23 175/229 |
| 4,183,417 | A | | 1/1980 | Levefelt | |
| 4,272,134 | A | | 6/1981 | Levefelt | |
| 4,294,492 | A | | 10/1981 | Evans | |
| 4,298,079 | A | | 11/1981 | Norlander et al. | |
| 4,359,113 | A | | 11/1982 | Morris | |
| 4,375,242 | A | | 3/1983 | Galle | |
| 4,386,668 | A | | 6/1983 | Parish | |
| 4,399,878 | A | * | 8/1983 | Karlsson | E21B 10/23 175/227 |
| 4,421,184 | A | * | 12/1983 | Mullins | E21B 10/18 175/337 |
| 4,445,791 | A | | 5/1984 | Klima | |
| 4,453,836 | A | | 6/1984 | Klima | |
| 4,508,183 | A | | 4/1985 | Drummond et al. | |
| 4,513,829 | A | | 4/1985 | Coates | |
| 4,515,228 | A | | 5/1985 | Dolezal et al. | |
| 4,515,229 | A | | 5/1985 | Drummond et al. | |
| 4,516,640 | A | | 5/1985 | Karlsson | |
| 4,540,055 | A | | 9/1985 | Drummond et al. | |
| 4,541,494 | A | | 9/1985 | Drummond et al. | |
| 4,549,820 | A | | 10/1985 | Mullins | |
| 4,598,778 | A | | 7/1986 | Highsmith | |
| 4,646,858 | A | | 3/1987 | Strickland | |
| 4,688,651 | A | * | 8/1987 | Dysart | E21B 10/23 175/337 |
| 4,741,406 | A | | 5/1988 | Deane et al. | |
| 4,750,573 | A | | 6/1988 | Wynn | |
| 4,805,709 | A | | 2/1989 | Johnsey et al. | |
| 4,813,502 | A | | 3/1989 | Dysart | |
| 4,848,476 | A | | 7/1989 | Deane et al. | |
| 4,981,182 | A | * | 1/1991 | Dysart | E21B 10/23 175/227 |
| 4,989,680 | A | | 2/1991 | Deane et al. | |
| 5,012,876 | A | * | 5/1991 | Bruchmiller | E21B 10/18 175/318 |
| 5,439,068 | A | | 8/1995 | Huffstutler et al. | |
| 5,513,711 | A | | 5/1996 | Williams | |
| 5,642,942 | A | | 7/1997 | Wagoner | |
| 5,740,871 | A | | 4/1998 | Williams | |
| 5,868,502 | A | | 2/1999 | Cariveau et al. | |
| 5,934,388 | A | | 8/1999 | Mattson | |
| 5,944,125 | A | | 8/1999 | Byrd | |
| 6,095,261 | A | | 8/2000 | Trevino, Jr. | |
| 6,116,357 | A | | 9/2000 | Wagoner et al. | |
| 6,170,582 | B1 | | 1/2001 | Singh et al. | |
| 6,227,315 | B1 | | 5/2001 | Debo et al. | |
| 6,264,367 | B1 | | 7/2001 | Slaughter | |
| 6,408,957 | B1 | | 6/2002 | Slaughter, Jr. et al. | |
| 6,484,823 | B2 | | 11/2002 | Olsson et al. | |
| 7,044,242 | B2 | | 5/2006 | Miglierini et al. | |
| 7,128,171 | B2 | | 10/2006 | Dick et al. | |
| 7,484,572 | B2 | | 2/2009 | Blackman et al. | |
| 7,552,783 | B2 | | 6/2009 | Viswanadham | |
| 8,337,085 | B2 | | 12/2012 | Nagaraj et al. | |
| 2007/0000698 | A1 | * | 1/2007 | Viswanadham | E21B 10/22 175/371 |
| 2010/0284636 | A1 | * | 11/2010 | Nagaraj | E21B 10/22 384/92 |

FOREIGN PATENT DOCUMENTS

| | | | |
|---|---|---|---|
| RU | 2019672 | C1 | 9/1994 |
| SU | 861538 | A1 | 9/1981 |
| SU | 1105600 | A1 | 7/1984 |
| WO | 2010128936 | A1 | 11/2010 |

OTHER PUBLICATIONS

Russian Office Action with Translation—Jun. 15, 2016 (issued in Application No. RU 2015128272/03(043851).

PCT/ISA/210—International Search Report—dated Oct. 18, 2013 (Issued in Application No. PCT/US2012/069722).

* cited by examiner

ROTARY DRILL BIT

CROSS-REFERENCE TO RELATED APPLICATIONS

This application is the national phase under 35 U.S.C. § 371 of PCT/US2012/069722 filed 14 Dec. 2012.

FIELD OF THE INVENTION

The invention relates to earth boring rotary drill bits and air/fluid flow passages through the bit structure.

BACKGROUND OF THE INVENTION

Rotary cone drill bits are primarily used in open pit mining and typically terminate in a structure that generally includes three lugs. A cone shaped bit including a plurality of cutting elements is arranged on each lug. The three cones are arranged such that they are angled toward a central point. A drilling fluid is used to evacuate drilled material from a hole as the bit drills into the material. The drilling fluid also cools and cleans bearing structures described below. When drilling with a rotary cone bit, the drill may be moved frequently. Air is typically used as the drilling fluid to increase the portability of the drilling apparatus.

FIG. 1 illustrates an example of a typical rotary bit in an upright position. The structure includes a central shaft 1. The shaft terminates with three lugs 3, 5, 7. A cone 9, 11, 13 is installed on each lug. FIG. 2 illustrates the structure shown in FIG. 1 such that a central axis of one of the cones is horizontal. FIG. 3 illustrates the structure shown in FIG. 2. FIG. 4 illustrates the view shown in FIG. 3 with only one lug shown.

FIG. 6 illustrates one of the lugs with the cone removed. To permit the cone to rotate on the lug, each lug includes a plurality of bearings and rollers. The lug and the cone include a plurality of races on which the bearings and rollers ride. This example of lug and bearing components includes a plurality of small rollers 17, a plurality of ball bearings 19 and a plurality of large rollers 21.

FIG. 7 illustrates an interior view of the cone. The cone includes races upon which the bearings and rollers ride when the bit is in use. This example of the cone includes a small roller race 23, a ball bearing race 25, and large roller race 27. The small rollers and small roller race may be referred to as an inner bearing. The large rollers and large roller race may be referred to as an outer bearing.

FIG. 8 illustrates the lug with the cone removed. As can be seen in FIG. 8, the lug includes a small roller race 29, a ball bearing race 31 and a large roller race 33. The bearings and rollers in place on the races is shown in FIG. 6.

The roller and bearing races are bounded and partially formed by flanges in the lug. Along these lines, small roller race 29 is bordered by pin flange 47 and thrust flange 49. Bearing race 31 is formed by thrust flange 49 and large roller race flange 51. The large roller race is bounded and formed by the large roller race flange 51 and the base flange 53. The diameter, thickness and contour of these flanges may vary depending upon the application and rollers and bearings being utilized.

To cool and facilitate removal of drilled material from the bearing cavity, the lug includes a plurality of passages extending therethrough. The passages direct fluid, typically air, from a central passage 15 in the shaft to the space between the lug and the cone as well as out of the end of the cone.

FIG. 9 illustrates a cross-sectional view of a lug with the cone attached. According to this example, the lug includes a long air hole, which feeds fluid from the shaft into the other passages in the lug and cone. The long air hole 35 feeds a plurality of additional passages 57 and 39 that branch off of the long air hole. Fluid, such as air, exits the long air hole and/or passages through various openings as described below.

FIG. 9 also illustrates the small rollers 17 and races 23, 29, ball bearings 19 and races 25, 31, and large rollers 21 and races 27 and 33. The lug and cone are formed such that spaces between the cone and lug will permit the fluid to pass between the lug and the cone. Such passages can include a secondary exhaust slot 67 (FIG. 8). The gap between the cone and lug at the perimeter may generate an "air curtain" that helps to prevent drilling debris from entering the space between the cone and the lug.

As also shown in FIG. 9, a ball plug 43 may be arranged in the flow passage 37. The ball plug retains the ball bearings after they are introduced into the bit assembly. Along these lines, the ball bearings help to retain the cone on the lug. The cone is typically assembled with the rollers already on the lug. The ball bearings may then be loaded through the flow passage 37 and out of ball loading hole 63 into the space between the lug and the cone where they ride on the ball race. The ball bearings lock the cone onto the lug. After the ball bearings are inserted, the ball plug 43 is inserted into ball loading hole 37 and welded into place to retain the ball bearings in the ball race and the cone on the lug.

Additionally, a thrust button may be installed or a weld added to the lug and cone and be arranged at the end of flow passage 39. The thrust buttons or welded flanges in the lug and cone form one of the two axial bearings at the end of passageway 39. The other and main axial bearing is the thrust flanges 49 for the lug and 25 for the cone.

Fluid flowing through the various flow passages can exit the lug from various passages in the lug. For example, FIG. 8 illustrates various openings through which the fluid may pass. The openings can include a centerline air hole 45 at the end of flow passage 39. Fluid flowing through the centerline air hole 45 can pass through a hole in the lug thrust button and may also be directed through slots 55 in the pin flange 47.

Fluid may exit the lug through thrust flange air holes 57 in the surface of the flange that faces the small rollers. The thrust flange may include a region of reduced thickness 59, or thrust flange mill slots (TFMS), in the vicinity of the thrust flange air holes to facilitate air flow out of the thrust flange air holes. To further direct fluid flow from the thrust flange air holes, the region of increased flange cut depth may be bordered by slot edges 61 in the surface of the thrust flange. Fluid may exit from flow passage 37 shown in FIG. 9 out of ball loading hole 63 shown in FIG. 8.

Fluid may also pass through a primary exhaust slot 65 and a secondary exhaust slot 67 arranged on the lug in the vicinity of the base of the cone. Air may pass through the primary exhaust slot and the secondary exhaust slot.

During drilling operations, the drill bit assembly shown in FIGS. 1-5 rotates in a clockwise direction from the perspective looking down the hole. The lowest parts of the cones shown in FIGS. 1 and 5 form the load bearing surfaces of the bit, with the lower leading edge 69 of the bit shown in FIGS. 1, 2, and 5.

When air is used as a drilling fluid, the air pressure may vary depending upon the application. According to one example, a minimum pressure of 45 psi or 3.1 bar is utilized. This can help to ensure delivery of sufficient air to the bearings and rollers to make them functional. The pressure can vary depending upon the specific drill rig and compressor being utilized, the operating altitude, as well as other factors. The size of the flow passages, including the nozzles, can vary to produce the desired pressure, depending upon the pressure affecting variables. It is desirable for the pressure to remain below a level at which compressors providing the air could modulate, which can reduce the overall output.

SUMMARY OF THE INVENTION

The structure of the fluid flow passages and openings in rotary cone bits has basically remained the same for decades. Embodiments of the invention are directed to optimizing flow of fluid through drill bits. Optimizing the fluid flow can enhance cooling of the bit and operation of the bit.

Embodiments of the invention include an air-cooled earth-boring drill bit including a plurality of lugs each having a cone arranged over the lug and a bearing structure including a plurality of roller bearings and ball bearings permitting the cone to rotate with respect to the lug. Each lug includes a pin flange at a tip of the lug. A first roller race is distal to the pin flange. A plurality of first rollers riding on the first roller race. A thrust flange is distal to the first roller race. A ball race is distal to the thrust flange. A plurality of ball bearings ride on the ball race. A ball race flange is distal to the ball race. A second roller race is distal to the ball race flange. A plurality of second rollers ride on the second roller race. A second roller race flange is distal to the second roller race. The lug includes at least one pin flange vent slot arranged in a surface of the pin flange opposite the first roller race and/or at least one thrust flange vent slot arranged in a surface of the thrust flange facing the first rollers. The at least one pin flange vent slot opens in a direction of a load side of the bearing. The at least one thrust flange vent slot opens in the direction of the load side of the bearing. A plurality of flow passages is arranged within the lug to supply fluid to the at least one pin flange vent slot and the at least one thrust flange vent slot.

Other embodiments of the invention provide an air-cooled earth-boring drill bit including a plurality of lugs each having a cone arranged over the lug and a bearing structure including a plurality of roller bearings and ball bearings permitting the cone to rotate with respect to the lug. Each lug includes a pin flange at a tip of the lug. A first roller race is distal to the pin flange. A plurality of first rollers ride on the first roller race. A thrust flange is distal to the first roller race. A ball race is distal to the thrust flange. A plurality of ball bearings ride on the ball race. A ball race flange is distal to the ball race. A second roller race is distal to the ball race flange. A plurality of second rollers ride on the second roller race. A second roller race flange is distal to the second roller race. A plurality of second roller race air exit slots are arranged distal to the second roller race flange. The second roller race air exit slots are arranged to create an air curtain substantially entirely around the drill bit. A plurality of flow passages within the lug supply fluid to the plurality of second roller race air exit slots.

Additionally, embodiments of the invention relate to a method for designing an air-cooled earth-boring drill bit including a plurality of lugs each having a cone arranged over the lug and a bearing structure including a plurality of rollers and bearings permitting the cone to rotate with respect to the lug. Each lug includes a pin flange at a tip of the lug. A first roller race is distal to the pin flange. A plurality of first rollers ride on the first roller race. A thrust flange is distal to the first roller race. A ball race is distal to the thrust flange. A plurality of ball bearings ride on the ball race. A ball race flange is distal to the ball race. A second roller race is distal to the ball race flange. A plurality of second rollers ride on the second roller race. A second roller race flange is distal to the second roller race. At least one fluid flow passage from an interior fluid flow passage within the lug to an exterior of the lug is introduced and/or a thickness of at least a portion of at least one of the flanges of the lug is increased to allow deeper TFMS for increased air flow. Fluid flow volume and velocity are analyzed and the introducing and analyzing are repeated until a desired flow volume and flow velocity are achieved.

Still other objects and advantages of the present invention will become readily apparent by those skilled in the art from the following detailed description, wherein it is shown and described only the preferred embodiments of the invention, simply by way of illustration of the best mode contemplated of carrying out the invention. As will be realized, the invention is capable of other and different embodiments, and its several details are capable of modifications in various obvious respects, without departing from the invention. Accordingly, the drawings and description are to be regarded as illustrative in nature and not as restrictive.

BRIEF DESCRIPTION OF THE DRAWINGS

The above-mentioned objects and advantages of the present invention will be more clearly understood when considered in conjunction with the accompanying drawings, in which.

DETAILED DESCRIPTION OF EMBODIMENTS OF THE INVENTION

Figure 1:
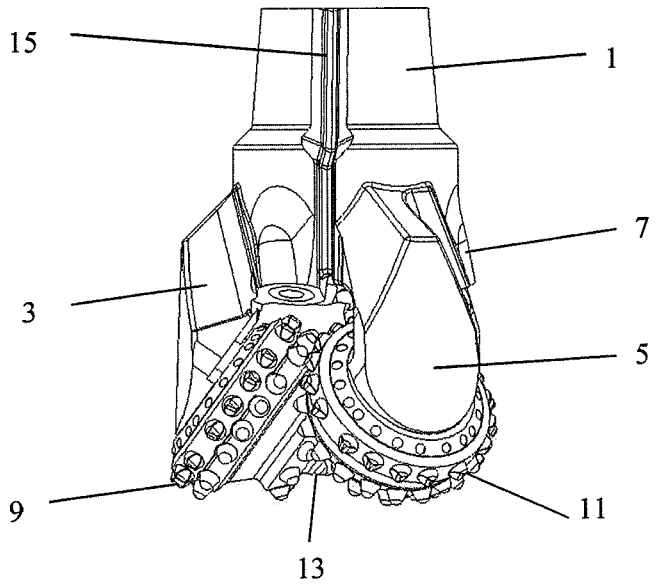
Fig. 1 (Prior Art)
FIG. 1 represents a view of a known rotary bit design in an upright, drilling position.
Figure 2:
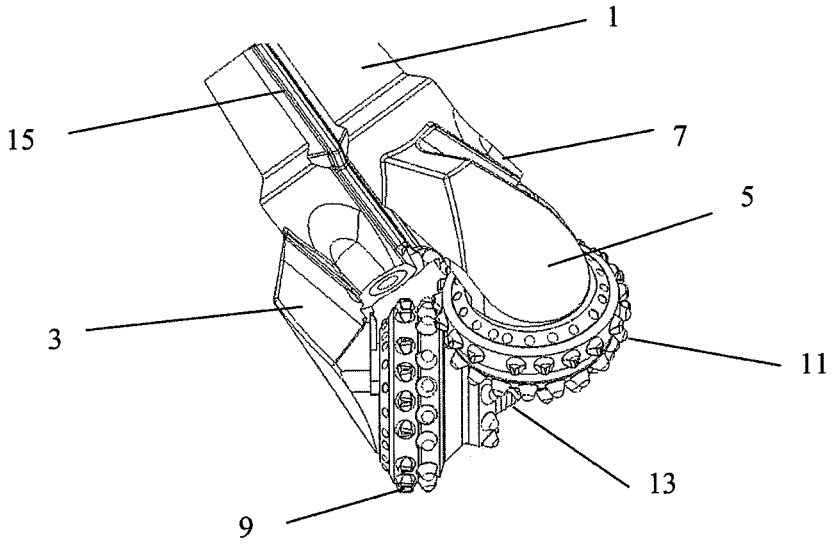
Fig. 2 (Prior Art)
FIG. 2 represents a view of the design shown in FIG. 1 rotated such that one cone is horizontal.
Figure 3:
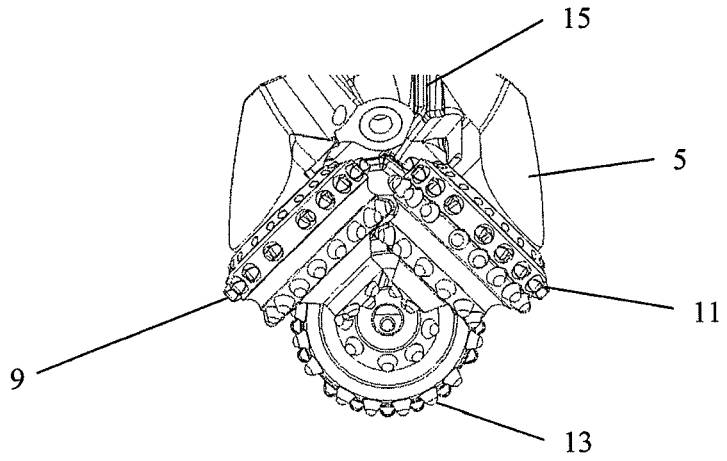
Fig. 3 (Prior Art)
FIG. 3 represents a view from the direction A-A shown in FIG. 2.
Figure 4:
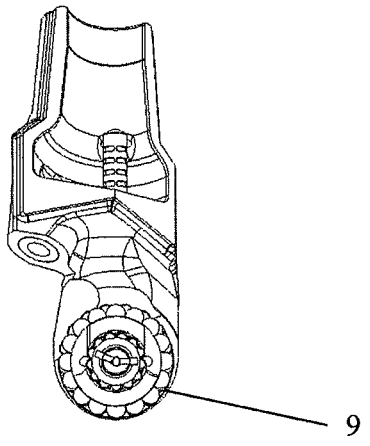
Fig. 4 (Prior Art)
FIG. 4 represents a view of the design shown in FIGS. 1-3 showing only one lug with the cone removed.

Design of rotary cone bits has not varied much fundamentally over time in spite of the fact that bearing failures are well known. To try to determine sources of drill bit failures, dull bits that had failed were examined and analyzed. The nature of the failures was analyzed. Bit designs in both new and worn states were computer analyzed in a loaded condition. By analyzing the bits in the loaded condition, clearances required for machining and assembly tolerance may be combined on an unloaded side of the bearings, thereby starving the load side of the bearings.

Two main sources of failure were identified. One of the sources was inner bearing failure. The second source was spalling on the outer bearing due to contamination causing irregular loading of the bearing surfaces.

Once the failures were analyzed, the design of the bits was analyzed to determine ways to increase air flow rates and patterns for improved cooling and cleaning. Such analyses identified elements of lug design having significant negative effects on fluid flow. Analysis results of the bearing/roller designs and bearing surfaces did not alter the designs fundamentally, thereby leaving the basic bearing design and geometry intact.

Modifications were then made to the basic geometry resulting in dramatic improvements in performance. As a result, embodiments of the invention can be implemented without needing to alter bit manufacturing processes. However, fluid flow geometry has been optimized in various ways to better cool and clean bearing cavities.

Objects of the modifications can include increasing the fluid flow through the bearing at a given pressure, increasing air flow to the inner bearing, which is a predominate source of early failure due to lack of cooling air, and/or redistribution of increased flow so that the flow through the bearing and average pressure of all bearing quadrants is maximized. Increasing flow increases cooling of the bearing structure including the bearings and rollers. Increasing air on a loaded side of the bit in particular will result in the bearings running cleaner, cooler and longer. Reduced contamination on the loaded side of the bearing structure in particular will delay wear due to spalling, pitting and corrosion.

Upon analyzing existing designs, it was found that air flow to the inner bearing was minimal. Along these lines, the air flow was on the order of about 6% of the flow into the bearing. The flow decreased from these minimal levels as wear occurred, dropping to about 3%.

Modifications to bit design included individual geometry modifications, combined geometry modifications, symmetric geometry modifications and fluid geometry detailing. Along these lines, individual geometry modifications were identified, any one of which improve fluid flow. Then, various individual modifications were made to further improve fluid flow. Advantages were also found in symmetrically arranging individual geometry modifications or combinations of individual geometry modifications. Furthermore, analyzing fluid geometry lead to the discovery that recirculation zones existed in the flow structure and modifications to the bearing structure can include modifications that reduce or eliminate recirculation zones. Any one or more of the individual geometry modifications, combinations of individual geometry modifications, symmetrically arranged geometry modifications, and/or fluid flow geometry modifications may be employed to enhance fluid flow and, hence, bearing life.

Figure 9:
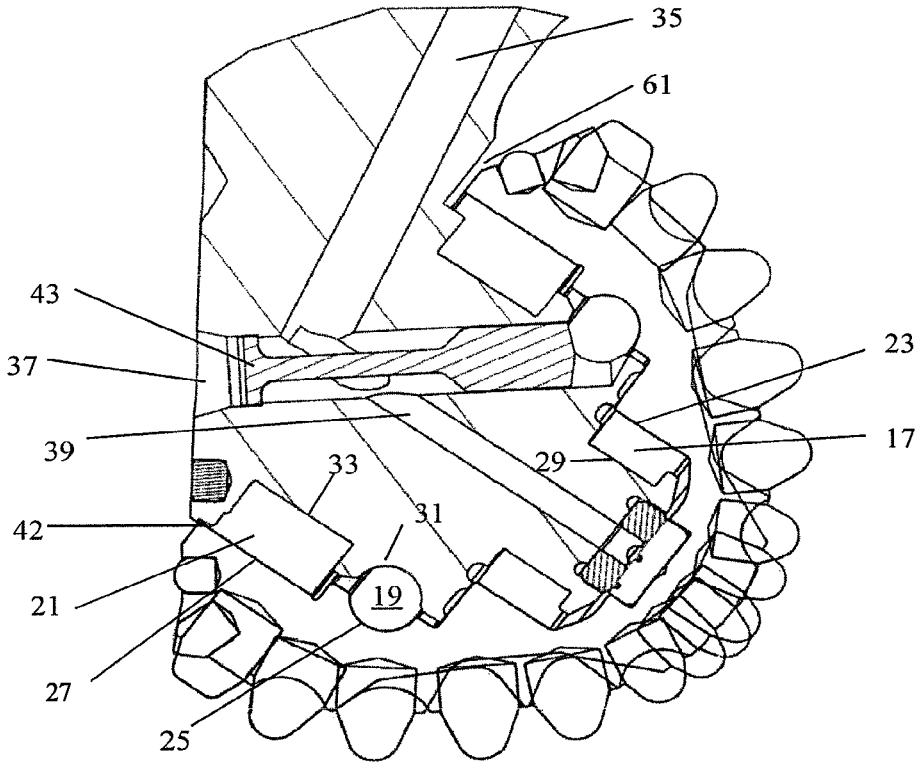
Fig. 9 (Prior Art)
FIG. 9 represents a cross-sectional view of the lug shown in FIG. 6.

As described above and shown in FIG. 9, air flowing out between the cone and the lug around the perimeter of the cone helps to prevent debris from entering the space between the cone and the lug and, hence, from entering the bearing races. In addition to finding low flow rates in new and worn bits, analysis showed that in the worn, loaded condition, a mass flow rate across the loaded side of the main roller race and exit velocity of air on the loaded side of the main roller race decrease as the bearing wears during service. As the air flow decreases, wear increases due to lack of cooling. With decreased air flow, debris will infiltrate the space between the cone and the lug at the lower perimeter gap 42 shown in FIG. 9.

Figure 5:
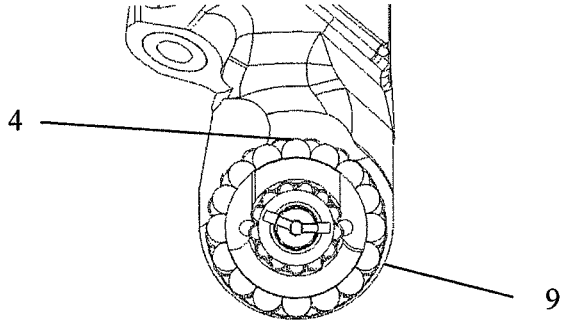
Fig. 5 (Prior Art)
FIG. 5 represents a close-up of the view shown in FIG. 4.
Figure 6:
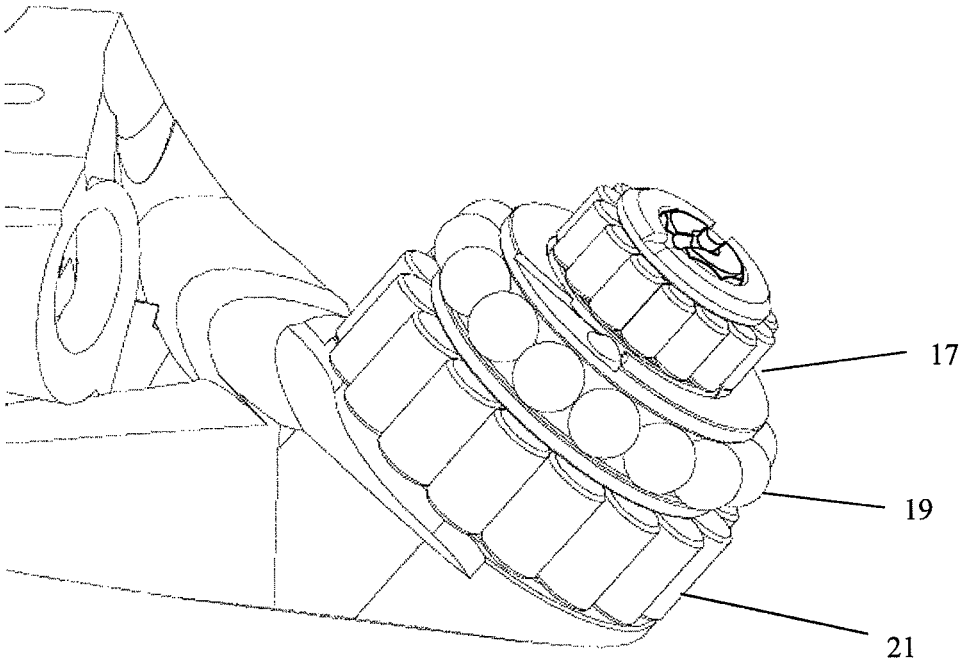
Fig. 6 (Prior Art)
FIG. 6 represents a view of one of the lugs in the design shown in FIGS. 1-5 with the roller bearings and ball bearings in place.
Figure 7:
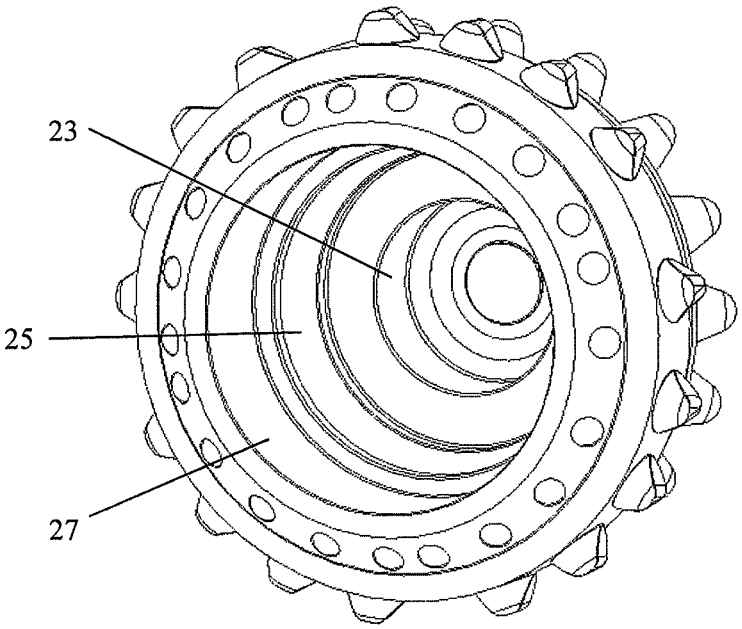
Fig. 7 (Prior Art)
FIG. 7 represents a view of the cone that would be assembled onto the lug shown in FIG. 6.

Flow characteristics of the bit vary greatly, depending upon if the bit is in a loaded or unloaded state. In an unloaded state, all components are assembled uniformly circumferential about the bearing axis, as designed. On the other hand, in a loaded state, the bit is analyzed under conditions experienced during use, as pressure would be applied to the bit assembly into material being drilled with all components contacting on the load side as shown in FIG. 5. In a loaded condition, clearance required for manufacturing and assembly of the bit is pushed to a side of the bit opposite the loaded side. This unloaded side 4 is located on the top of the bearing as shown in FIG. 5. The larger clearance on the unloaded side of the bit reduces air flow on the loaded side of the bearing, which has reduced clearance. The air will naturally take the path of least resistance and/or the shortest path through the bit structure where there is less debris and the perimeter gap is greatest on the unloaded side of the bearing.

Figure 10:
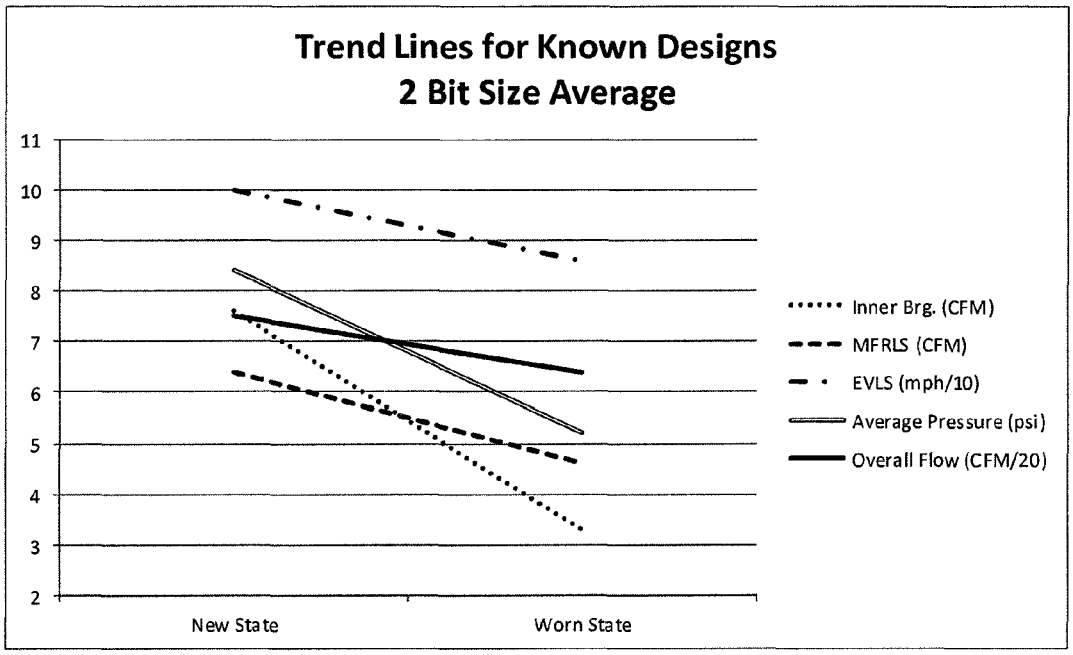
FIG. 10 represents a graph that illustrates average flow rates for two different sizes of the bit design shown in FIGS. 1-9.

Existing solutions only address flow in a new, unloaded state, which inaccurately reflects conditions during use and after wear. FIG. 10 is a graph that illustrates average values for air flow rates, velocities and pressures in a new and worn state for two sizes of bits analyzed. In particular, the bits had a diameter of about 11 inches or about 12.25 inches. The wear was assumed to be about 0.050 inch to the axial and radial bearings, which simulates wear typically at a point about one-half to two-thirds through the service life of a bit. As can be seen in FIG. 10, the flow rate is drastically affected by such a small amount of wear.

Embodiments of the invention address the shortcomings of known bit designs to redistribute air flow through the bearing structure, exclude debris from the bearing and protect the wear side of the bearing as wear progresses during use. Embodiments of the invention can include one or more of a number of different changes to bit design to improve air flow and decrease wear. Improvements to air flow can include a more uniform flow of air about the bearing structure and maintain the flow throughout bearing life. The improvements can reduce wear from the new state though the worn state. Some of the most significant improvements are to air flow through the bearing in the worn state. By increasing air flow, embodiments of the invention reduce wear rates and bearing failure rates.

By making the air flow through the bearing more uniform, or symmetric, about the bearing structure the distance that air flows through the bearing from inlets to outlets can be reduced. Symmetry can be relative to horizontal and vertical planes. Exit flow can be symmetric with respect to the vertical plane. However, exit flow cannot be symmetric with respect to the horizontal plane. This is because an air exit slot on the lower leading edge of the bearing would become filled with debris and/or provide a debris path in a location where such debris could cause the most damage. Fluid flow may be symmetric with respect to a plane that is rotated about 20° from bottom dead center. This is due to the movement of the force bottom dead center as a result of the rotation of the bit during use. The fluid flow could be symmetric with respect to the plane or about the plane.

Modifications of the lug design include changes in flow paths within the lug, vent holes permitting air to exit the lug, grooves and/or slots in the lug flanges, contours of air flow grooves and/or slots and/or corner contours. Some of the changes helped to eliminate dead areas with little or no air flow. The modifications may be employed in any combination or all together to achieve various degrees of airflow improvement.

Figure 11:
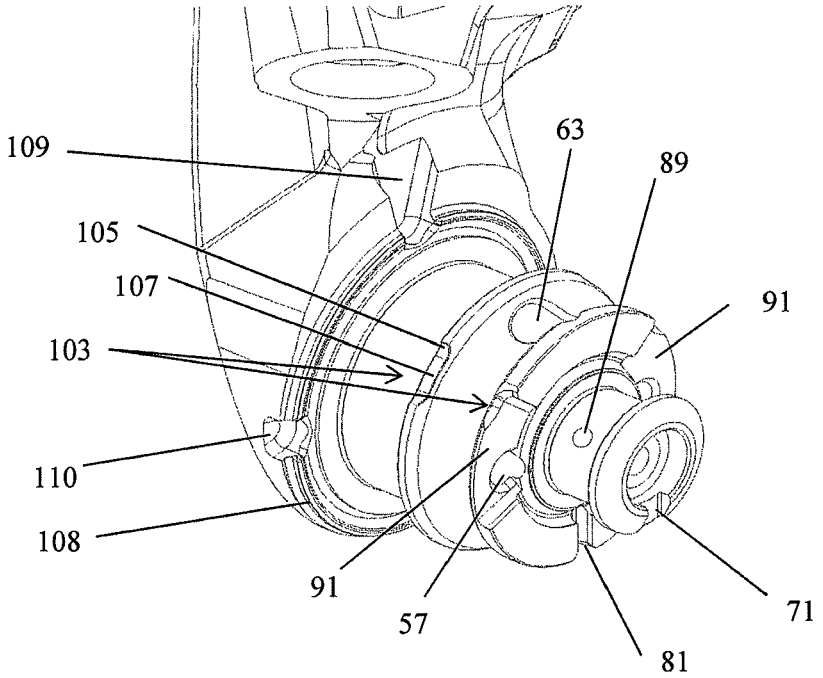
FIG. 11 represents an embodiment of a lug according to the invention.

FIG. 11 illustrates an embodiment of a lug according to the invention. The embodiment shown in FIG. 11 includes a slot 71 in the pin flange 47. In this embodiment, the pin flange slot 71 is a single, strategically oriented slot milled in the pin flange. This is a change from the known design shown in FIG. 8 with multiple, shallow slots at various orientations.

In the embodiment shown in FIG. 11, the pin flange slot is arranged on the bottom edge of the pin flange. The pin flange slot may extend through the pin flange at an angle to bottom dead center of the lug to account for a shift in a load on the bearing from bottom dead center of the bearing during use. The pin flange slot may have a depth of about 50% to about 75% of the thickness of the pin flange.

Typically, the pin flange includes one slot as shown in FIG. 11. However, improved air flow may also be achieved with more than one slot, with one slot arranged other than shown or described here and or having dimensions other than those described herein.

Figure 12:
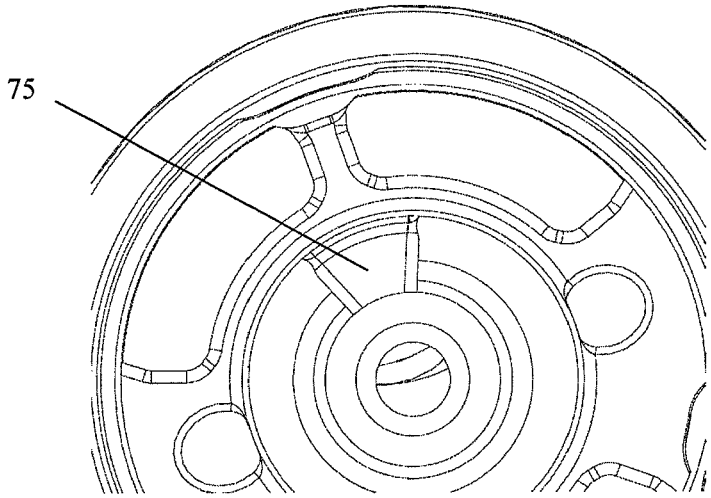
FIGS. 12 and 13 represent close-up views of an embodiment of a pin flange slot according to the invention.

In the embodiment of the pin flange slot shown in FIG. 11 extends with sides that are not parallel to each other such that the pin flange slot has an expanding width toward the outer edge of the pin flange, as shown in FIG. 12. Along these lines, the pin flange slot could have a diverging angle between about 10° and 150°. However, the pin flange may open with any diverging geometry. The diverging geometry can help to spread out the air coming through the thrust button at the end of the lug.

To increase fluid flow through slots, such as the pin flange slot or any of the other slots described herein, the thickness of the flange in which the slot(s) is formed may be increased as compared to known designs. This can increase the depth of the slot(s) and thereby increase fluid flow through the slot(s). As a result, the flanges may have an increased thickness as compared to the overall length of the bearing. In some cases, this may result in reduced bearing size, such as rollers having reduced lengths and/or ball bearings having reduced diameters as compared to known designs.

Figure 13:
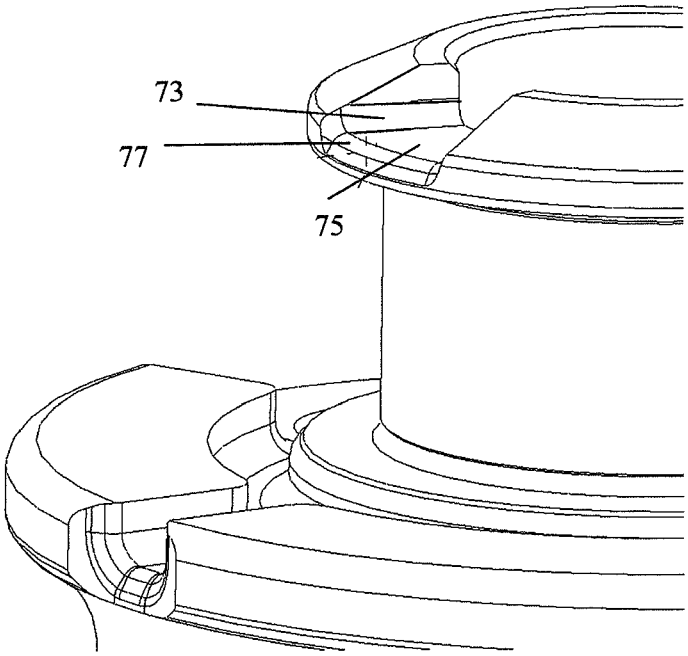

To further improve air flow, the edges of the pin flange slot as well as other slots and grooves in the lug may be modified from known designs. Along these lines, the edges of the inner and outer openings of the pin flange slot may include a chamfer and the border between the side 73 and bottom surface 75 of the pin flange slot and interior and exterior surfaces of the pin flange may be rounded. According to one embodiment shown in FIG. 13, the chamfer is angled at about 60° with respect to the side and bottom surfaces of the pin flange slot. Additionally, the border 77 between the chamfer and the bottom surface 75 may be rounded as shown in FIG. 13. Both the chamfer angle and the rounded borders can help to reduce recirculation zones found to exist within and at edges of the pin flange slot.

The angle of the chamfer may vary between about 35° and about 75°. Typically, the rounded borders are circular arcs, but may have another curvature. The side 73 and bottom surfaces of the pin flange slot may be planar. However, the side and/or bottom surfaces may have other contours. As with the border between the pin flange slot and the inner and outer side surfaces of the pin flange, the border between the side and bottom surfaces of the pin flange slot may include a curved intersection. Alternatively, side and bottom surfaces could meet at a right angle or have a chamfer.

The thrust flange 49 may also include a vent slot 81 arranged generally in line with the pin flange vent slot. Arranging a vent slot 81 in the thrust flange in this region may result in a flow path over the lug that increases flow to the critical loaded surface of the bit assembly, as indicated by arrow 83 in FIG. 21. This flow path may be considered as a "power washer". This power washer adds a high flow regions where there would ideally be an exit slot. An exit slot in this position would pack with debris due to its location with respect to the load side of the bit. The power washer can create a "virtual" exit slot. This feature alone can provide dramatic decreases in wear rates and increases in bearing life by cooling and debris reduction.

In the embodiment shown in FIG. 11, the thrust flange vent slot 81 is in line with the pin flange slot in the orientation shown in FIG. 11. In this position, the thrust flange vent slot may extend through the thrust flange at an angle to bottom dead center of the lug to account for a shift in load from bottom dead center during use. The thrust flange vent slot may have a depth of about 40% to about 75% of the thickness of the thrust flange.

In the embodiment of the thrust flange vent slot shown in FIG. 11 extends with sides that are substantially parallel to each other such that the thrust flange vent slot has a constant width. Along these lines, the pin flange slot could have a width of about 50% to about 250% of the width of the trust flange slot.

The surface of the thrust flange vent slot may include planar and/or curved surfaces. The embodiment shown in FIG. 14 includes both planar side surface 79 and bottom surface 81 and curved region 83 between the two planar surfaces. The side and bottom surfaces may also meet in at a right angle, chamfer or smaller curved portion. The entire surface of the thrust flange vent slot may also be curved.

Figure 14:
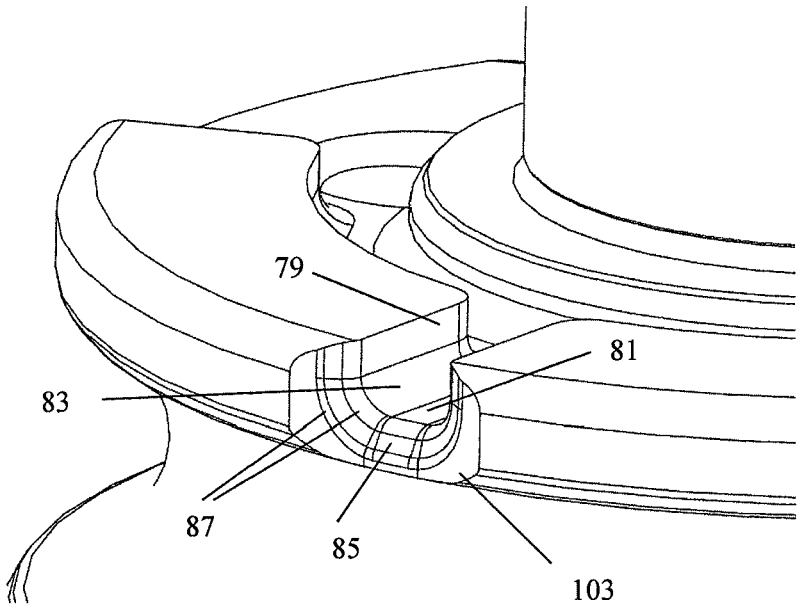
FIG. 14 represents a close-up view of an embodiment of a thrust flange vent slot according to the invention.

As with the pin flange slot, to further improve air flow, the edges of the thrust flange vent slot may also be modified from known designs. Along these lines, the edges of the inner and outer openings of the thrust flange vent slot may include a chamfer 85 and the border between the side surface 79, bottom surface 75 and curved border 83 of the thrust flange vent slot and interior and exterior surfaces of the thrust flange may be rounded. According to one embodiment shown in FIG. 14, the chamfer is angled at about 60° with respect to the side and bottom surfaces of the pin flange slot. Additionally, the border 87 between the chamfer 85 and the side surface 79, bottom surface 75 and curved border 83 as well as the may be rounded as shown in FIG. 14. The angle of the chamfer may vary between about 35° and about 75°. Typically, the rounded borders are circular arcs, but may have another curvature. Both the chamfer angle and the rounded borders can help to reduce recirculation zones found to exist within and at edges of the thrust flange vent slot. The transition between a chamfer and another surface may be considered as blended edges. FIG. 14 also illustrates a ball race relief cut 103. Such blended edges do not include corners that meet at a 90° angle.

Another improvement to the bit design that may be included in embodiments of the invention is one or more vent holes in the small roller race. The embodiment shown in FIG. 11 includes two small roller race vent holes 89. The location of the small roller race vent holes may vary. Typically, the holes are on the unloaded side of the lug. The hole(s) may be symmetrically arranged with respect to the center of the load or with bottom dead center of the lug.

The size of the small roller race vent hole(s) may vary. The size must not be so big that the hole(s) interferes with the operation of the small rollers. Typically, the small roller race vent holes have a diameter of about 20% to about 50% of the length of the race in which they are placed.

Similar to the intersections of other surfaces in the design, the edges of the small race vent holes at the small roller race may have a contour other than a 90° corner. Eliminating a sharp 90° edge by introducing a break into the design can help to facilitate flow through the bearing by reducing and/or eliminating turbulent flow and/or dead zones in the flow.

The thrust flange may include other flow passages in addition to the thrust flange vent slot. Along these lines, at least one thrust flange milled slot 91 may be provided in the surface of the thrust flange that faces the small roller race.

The orientation and placement of the thrust flange milled slot(s) may vary. The embodiment shown in FIG. 15 includes two thrust flange milled slots 91. The thrust flange milled slot(s) may have a depth of about 40% to about 75% of the thickness of the thrust flange. The thrust flange milled slot(s) may typically increase in width from interior of the thrust flange toward the exterior of the flange. A substantial portion of the bottom surface of the thrust flange milled slot may be substantially planar.

Figure 16:
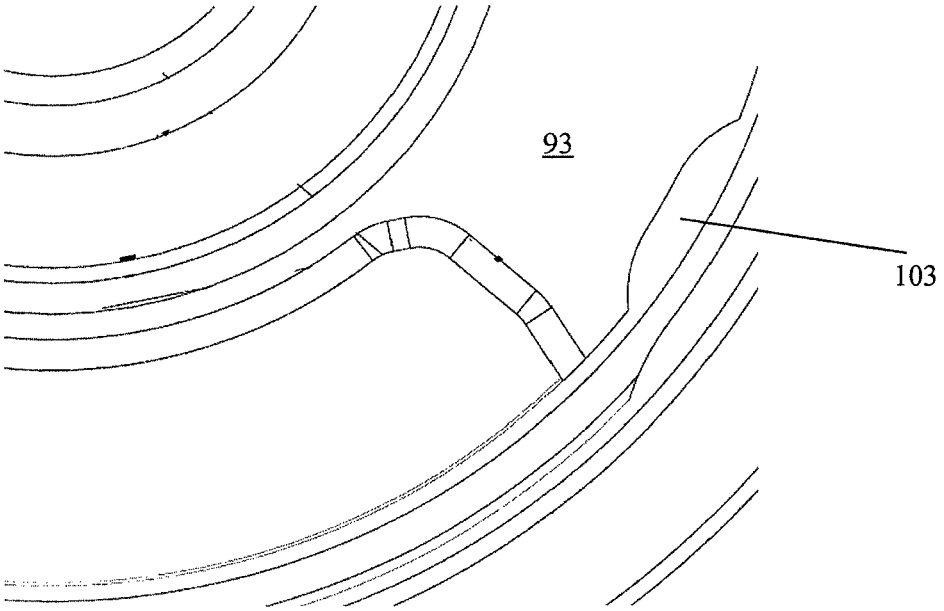
FIG. 16 represents a close-up view of a side edge of an embodiment of a thrust flange slot according to the invention.
Figure 17:
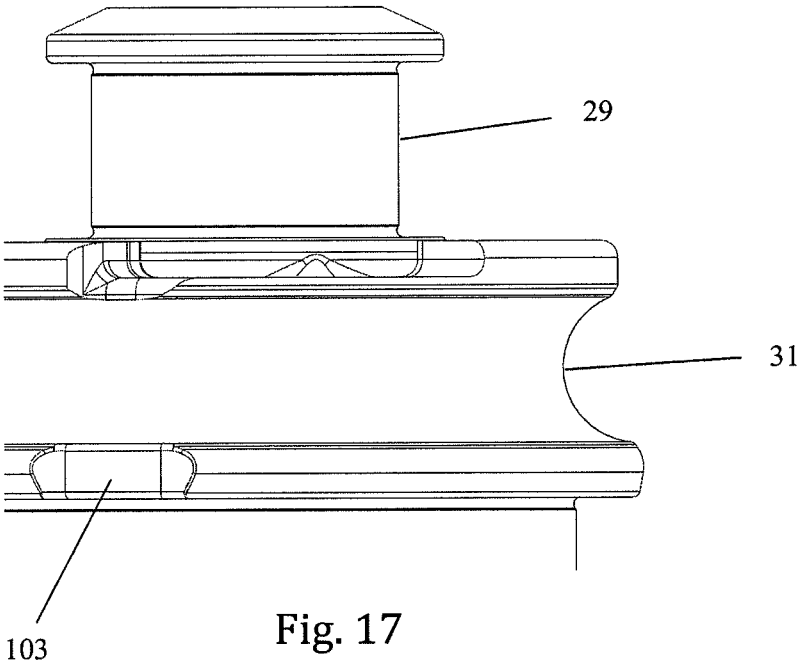
FIG. 17 represents a cross-sectional view of an embodiment of a portion of a journal according to the invention.

However, the side surfaces may be curved so as to eliminate or reduce recirculation zones. Analysis identified the side surfaces 95 of the thrust flange milled slot as a region where recirculation occurs. Curvature of this surface can reduce or eliminate the recirculation zones. FIG. 16 illustrates an example of a curvature that the thrust flange milled slot may have. A complex curvature as shown in FIG. 16. Along these lines, the embodiment shown in FIG. 16 includes a plurality of curved and also planar portions. The side surfaces of the thrust flange milled slot may have other curvatures and be made up of other combinations of curved and planar surfaces that reduce or eliminate recirculation in this area.

In addition to having a curved surface, the border between the side surfaces 95 and the bottom surface 93 of the thrust flange milled slot may include a chamfer and/or curved portions as described above in connection with the pin flange slot and thrust flange vent slot. Similarly, the border between the bottom surface 93 of the side surface of the thrust flange may include a chamfer and/or curved surfaces similar to the pin flange slot and thrust flange vent slot.

Figure 15:
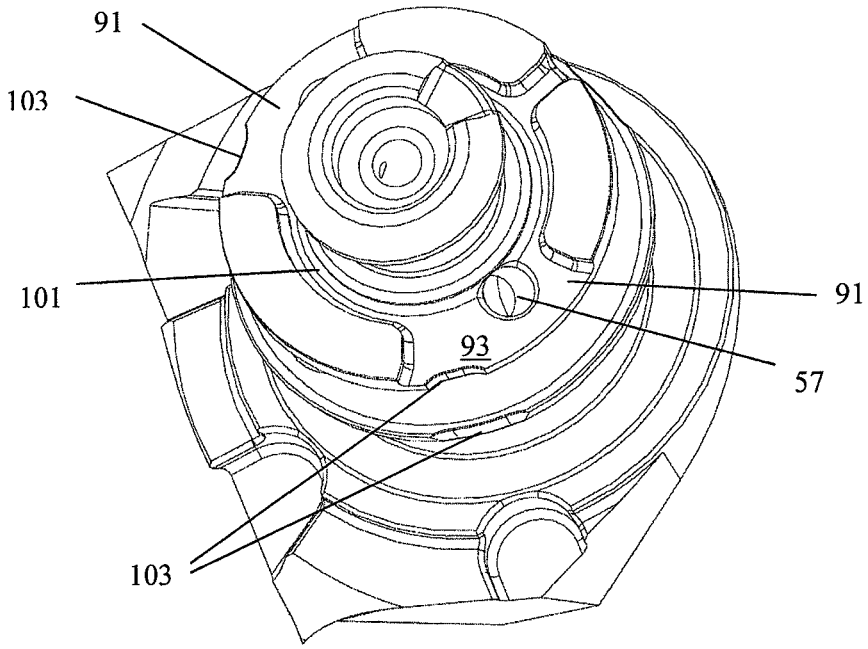
FIG. 15 represents an embodiment of a thrust flange according to the invention.

The thrust flange air hole 57 may open at least partially into the thrust flange milled slot as in the embodiment shown in FIG. 15. As shown in FIG. 15, the intersection of the thrust flange air hole and the bottom surface of the thrust flange milled slot may include a chamfer and/or a curved surface.

As also shown in FIG. 15, the thrust flange may include a small roller race air groove 101. The small roller race air groove may extend entirely about the thrust flange. Such an embodiment of the small roller race air groove provides a flow path connecting the thrust flange vent slot, thrust flange milled slots and thrust flange air hole, which can at least partially open in the small roller race air groove. In some embodiments, the small roller race air groove may not extend entirely around the thrust flange.

The small roller race air groove may extend into the surface of the thrust flange to a similar depth as the thrust flange vent slot, thrust flange milled slots and thrust flange air hole. This can create a more uniform fluid geometry through the small roller race air groove, thrust flange vent slot, thrust flange milled slots and thrust flange air hole. If the thrust flange vent slot and/or thrust flange milled slot(s) are not planar with the small roller race air groove, then typically, they are within about 10% to about 25% of their depth. If the thrust flange vent slot and/or thrust flange milled slot(s) are not planar with the small roller race air groove then typically, the intersection of the thrust flange vent slot and/or thrust flange milled slot(s) with the small roller race air groove is rounded and/or includes a chamfer. This can help to reduce recirculation zones and increase flow volume.

The edges of the side surfaces of the small roller race air groove may include a chamfer and/or curves where they meet the side surfaces edges of the thrust flange milled slot, side surfaces of the thrust flange vent slot, surface of the thrust flange and/or side of the thrust flange air hole. The intersection of the ball loading hole 63 and the ball race 31 may also include a chamfer and/or curves. Typically, if any of the intersections of various surfaces described herein include a chamfer, the intersection of the chamfer and the surface(s) are blended, such as by being curved or rounded, rather than meeting at a discrete angle. Rounded or blended edges can help to reduce recirculation zones, turbulent flow, and dead zones and increase flow volume.

To further enhance air flow, the flange 51 between the ball race and the large roller race and/or the thrust flange may include at least one ball race relief cut 103. If the lug includes ball race relief cuts, the number of cuts may vary. The embodiment shown in FIG. 11 includes six ball race relief cuts on each of the flange 51 and the thrust flange. The cuts may be symmetrically arranged about the flange 51 and the thrust flange. Alternatively or additionally, the ball race relief cuts may be arranged in line with one or more other features, such as the thrust flange vent slot, thrust flange milled slot, among the others. The ball race relief cuts on the flange 51 and the thrust flange may be aligned. Along these lines, the ball race relief cuts may be arranged about 120° apart according to one embodiment. The ball race relief cuts may be arranged from about 20° apart to about 180° apart. The distance can depend upon the number of cuts, among other factors.

The ball race relief cut(s) may extend entirely through the thickness of the flange 51 and/or the thrust flange. The sides 105 of the ball race relief cuts may be curved as in the embodiment shown in FIG. 11. Alternatively, the sides of the ball race relief cuts could be planar and meet the bottom surface 107 of the ball race relief cuts at a right angle. The border between the side surfaces of the ball race relief cuts and the bottom surface of the ball race relief cuts and/or side surface of the flange 51 and/or the thrust flange may include a chamber and/or curved surfaces as described above. As with any of the chamfered/curved surfaces, the angles described above may be utilized.

Figure 8:
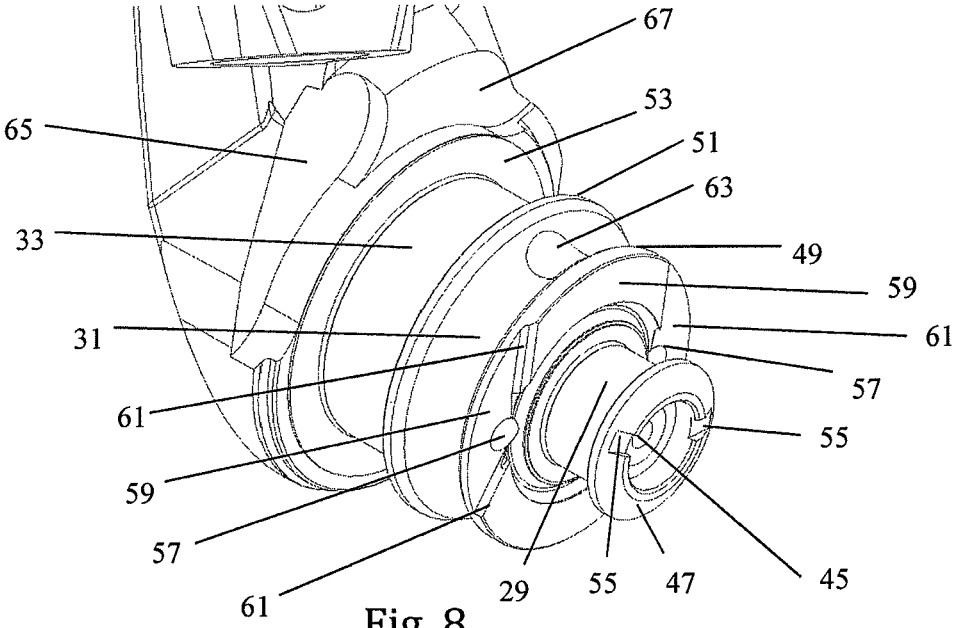
Fig. 8 (Prior Art)
FIG. 8 represents a view of the lug shown in FIG. 6 with the bearing components removed.

A further enhancement that embodiments of a bit design according to the invention may include is one or more air exit slots arranged at the base of the journal after the flow passes over/through the large roller race. The opening of the exit slot(s) may face outwardly to direct air perpendicularly with respect to the central axis of the journal. The journal is the portion of the bearing shaft that protrudes from the end of the lug. Typically, as shown in FIG. 8, the journal 141 extends at an angle from the lug or bit axis. The extent of the journal fits into the cone and is typically about one-third of the bit body from top to bottom, so that the lug axis is the same as the bit axis.

The embodiment shown in FIG. 11 includes three air exit slots 109, 110. The slots are arranged about 30° to about 110° apart, with two on opposite sides of the lug and one on the top as shown in FIG. 11. The view shown in FIG. 11 does not illustrate the slot on the opposite side of the lug from slot 110. The slot 109 at the top of the lug in the view shown in FIG. 11 is opposite the load side of the lug. Arranged as such, the slot 109 can form an offset from the "power washer" formed by the pin flange slot and thrust flange vent slot.

The lug may include slot 110 and a slot on the opposite side. The lug may actually include multiple slots about the lug as long as the lug flow from the slots will balance across a plane that bisects or closely bisects the plane including or closely including slot 109 and/or other features relative to the vertical or close to vertical plane that centers on the load/unload areas of the bearing. This may mean that the same number of slots are arranged on each side of the plane or unequal numbers of slots may be provided. The arrangement of the slots may be symmetric with respect to one of the above planes or nearly symmetric. On the other hand, the slots may not be symmetrically arranged with respect to one of the above planes if the flow produced by the slots is symmetric.

An advantage of the exit slot(s) 110 that may be included in embodiments of the invention as compared to known designs may include that the exit slot(s) 110 may be manipulated in quantity, placement and size to result in a desired distribution of air flow and/or to establish an effective air curtain. Known exhaust slots allow most of the air to exit through the top of the bearing without establishing an air curtain for debris exclusion.

Figure 11A:
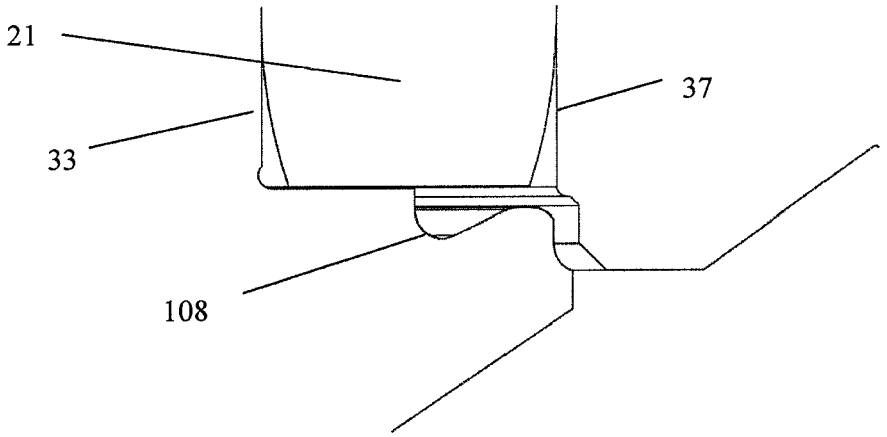

The flange 53 defining the large roller race may include an air groove 108 extending entirely or partly about its circumference. The large roller race air groove 108 may help to circumferentially distribute fluid flow about the entire lug and cone. The groove may be selectively arranged interruptedly or uninterruptedly at intervals around the circumference to manipulate flow between bearing quadrants, if desired. FIG. 11*a* illustrates an embodiment of a large roller race air groove in cross-section.

Figure 18:
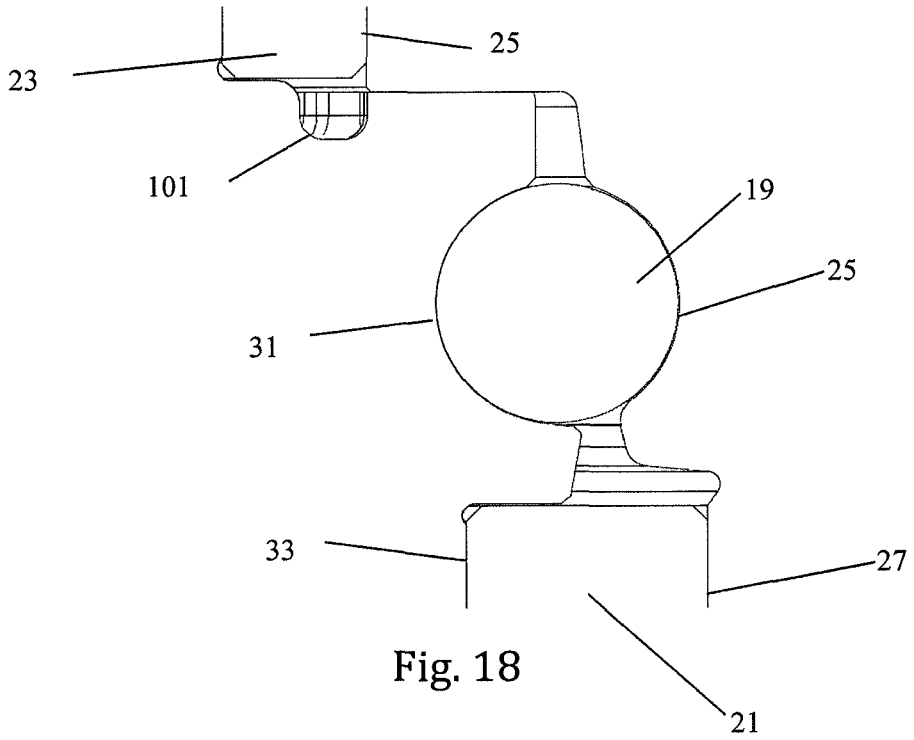
FIG. 18 represents a portion of an embodiment of a lug and cone according to the invention and a portion of the small rollers, ball bearings and large rollers.
Figure 18A:
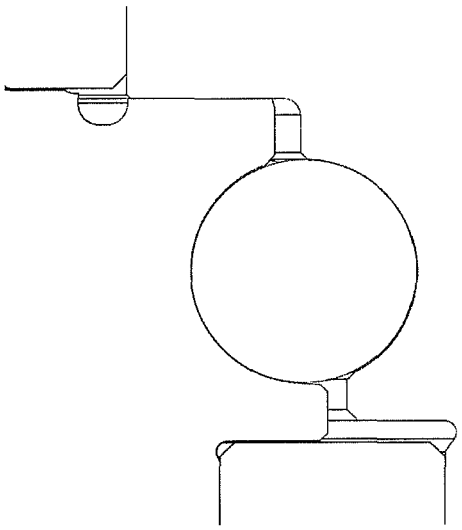
Fig. 18a (Prior Art)
FIG. 18*a* represents a close-up view of a portion of a known design of a lug and cone including a portion of the ball bearings and large rollers.

Other enhancements to the fluid flow that may be included in embodiments of the invention can include flange surfaces that are contoured to produce a diverging geometry. An embodiment of a portion of the lug and cone are shown in FIG. 16. FIG. 18 illustrates a portion of the small rollers 23, small roller race air groove, small roller race 25, thrust flange 49, bearing race 31 and 25, bearing 19, large roller 21, and large roller race 33 and 27. As shown in FIG. 18, the end surfaces of the flanges 49 and 51 and complementary surfaces on the cone may have contours that create spaces for fluid flow and produce a fluid flow with diverging geometry. For example, edges of the flanges may be rounded, as shown in FIG. 18, rather than including chamfers as in known designs. The changes to flange surfaces on the journal and the corresponding cone can positively affect the fluid flow in the outward direction, which is away from the tip of the journal at the lower extreme of the lug. For example, elimination of chamfers can eliminate sharp edges that can disrupt flow patterns. In contrast, according to known designs, the fluid volume between the flanges had a converging or at best parallel geometry that negatively affected flow in the outward direction, as shown in FIG. 18*a*.

Figure 19:
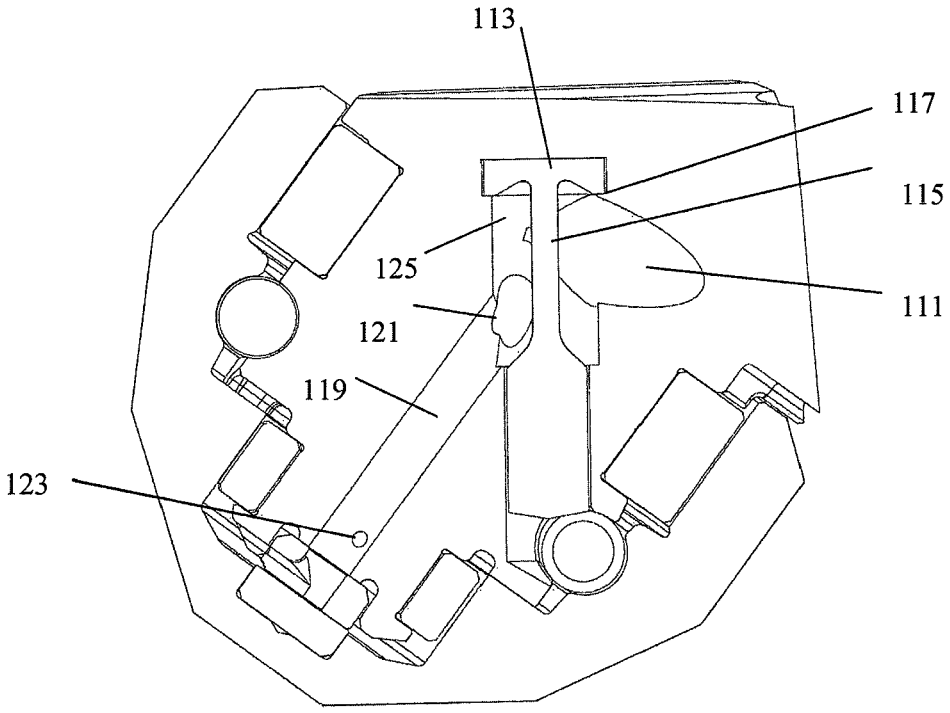
FIG. 19 represents a cross-sectional view of an embodiment of a bit structure according to the invention, showing internal flow paths in the lug.
Figure 20:
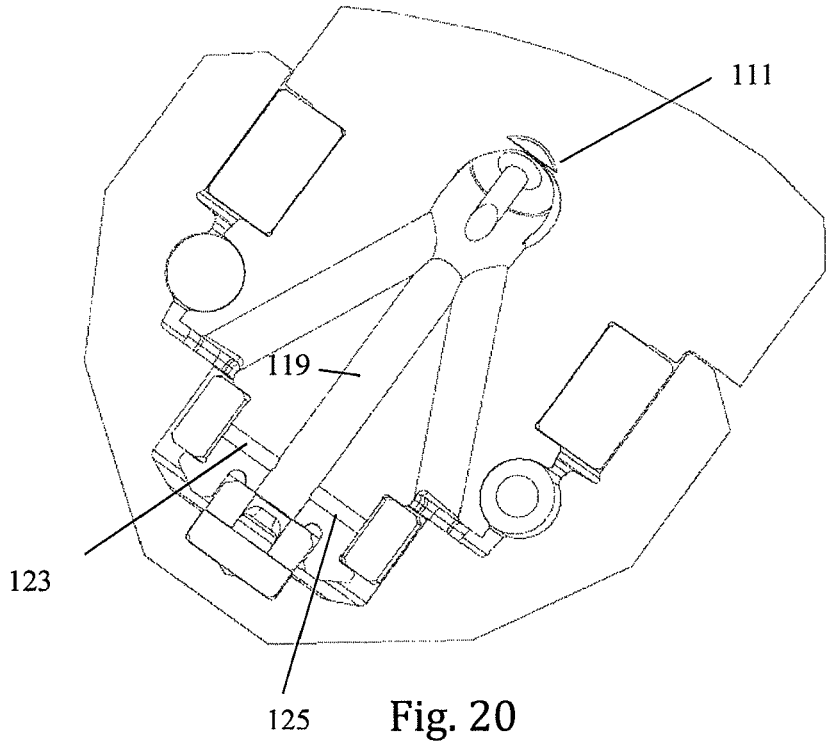
FIG. 20 represents a cross-sectional view of an embodiment of a bit structure according to the invention that is perpendicular to the embodiment shown in FIG. 19.

In addition to altering the design of the exterior surface of the lug, the invention can include improvements to the flow paths within the lug. FIGS. 19 and 20 illustrate the interior flow passages in the lug from two cross-sections that are perpendicular to each other. As shown in FIG. 19, the ball plug 113 in ball loading passage 125 that directs fluid from the long air hole 111 to the other flow passages, such as flow passage 119, within the lug has been modified to reduce recirculation zones. For example, the guide surfaces 113 on the ball plug have been modified such that its edge meets the edges of the long air hole, such as at intersection 117 and with the flow passage 119 at intersection 121. Additionally, the contour of the side walls of the flow passages may be altered to enhance fluid flow. Furthermore, the diameter of the flow passages may be expanded, especially between points 117 and 121, in some embodiments to increase the fluid flow around the center stem of ball plug 113 in the same area. This may provide an increased flow volume to feed additional flow outlets, such as small roller race vent hole(s) 89, feed passages 123 may be added as branches off of flow passage 119.

The cross-sectional view shown in FIG. 20 illustrates small roller race vent hole feed passages 123 and 130 providing flow to the small roller race from passage 119, which feeds the thrust button. As shown in FIG. 20, the ball plug stem 113 and intersecting holes may be arranged in different planes to facilitate fluid movement around the ball plug stem 113. In general, holes that intersect with the ball loading hole are configured to reduce recirculation zones. Additionally, the ball plug stem may be shortened and the lower body of the stem lengthened. The ball plug stem head may have a concave lower portion. Also, all hole diameters may be maximized and the center hole may be offset relative to the pin flange. All of these modifications to the ball plug and holes may reduce recirculation.

Figure 21:
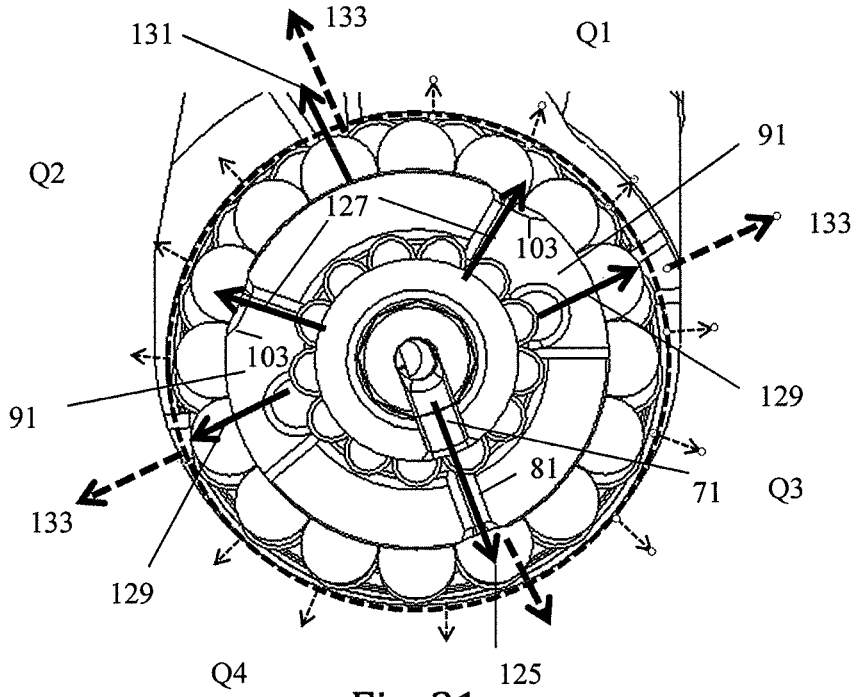
FIG. 21 represents an embodiment of a lug according to the invention with the bearing structure including the large rollers, small rollers and ball bearings in place, illustrating fluid flow.

FIG. 21 illustrates a view of the lug with the rollers and bearings in place showing the air flow according to an embodiment of the invention. This embodiment includes all of the above-discussed features to improve fluid flow in the bit structure to illustrate flow through the bit. Along these lines, the alignment of the pin flange slot 71 and the thrust flange vent slot 81 help to create a flow of fluid down the lug and interior of the cone as illustrated by arrow 125. With the bit in use, this fluid flow directly toward the load bottom dead center or within about 35° of either side of the load bottom dead center. This ensures that fluid flows in a critical area prone to the build-up of debris.

Other features that help to distribute fluid about the bit structure include the small roller race vent hole, which the embodiment shown in FIG. 21 includes two. These vent holes produce flow indicated by arrows 127. This flow is further directed by the thrust flange milled slots 91 and the ball race relief cuts 103.

Additionally, the fluid flow through the thrust flange holes 59 produces flow indicated by arrows 129 and ball loading hole produces flow indicated by arrow 131. Furthermore, exit slots 109 produce flow indicated by arrows 133.

The distribution of air about the bit helps to generate an air curtain 125 that surrounds the bit. This can help to more efficiently cool the bearing structure. The flow can also help to prevent entry of debris into the perimeter gap 42 between the lug and the cone. Additionally, the modifications according to the invention can increase fluid exit velocity. The effectiveness of the air curtain can increase with increases in mass flow rate on the load side and exit velocity on the load side. The effectiveness of the air curtain can also increase as the pressure variations among quadrants decrease. Along these lines, low pressure zones can permit more debris to enter a bearing.

Figure 22:
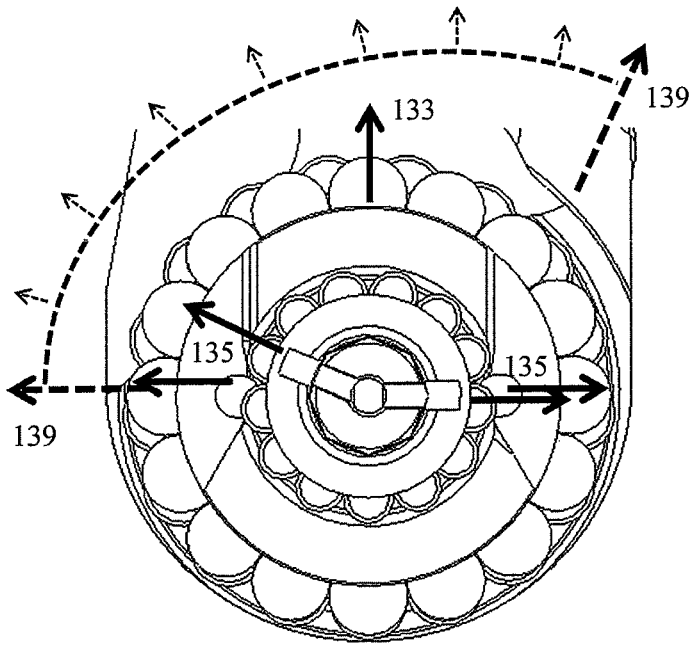
FIG. 22 represents a known design of a lug the bearing structure including the large rollers, small rollers and ball bearings in place, illustrating fluid flow.

This is in contrast to the fluid flow in a known bit structure as shown in FIG. 22. As shown in FIG. 22, the fluid flow is all directed in the upper half of the structure in the orientation shown in FIG. 22. Along these lines, the pin flange slots 55 and thrust flange holes 57 direct the flow laterally or upwardly away from the geometric bottom dead center as indicated by arrows 135. Additionally, the ball loading hole directs air upwardly as indicated by arrow 137. Furthermore, primary and secondary exhaust slots direct fluid as indicated by arrows 139. All of these elements result in direction of fluid about a fraction of the circumference of the bearing, leading to inadequate cooling and debris infiltration of the bearing structure.

Figure 23:
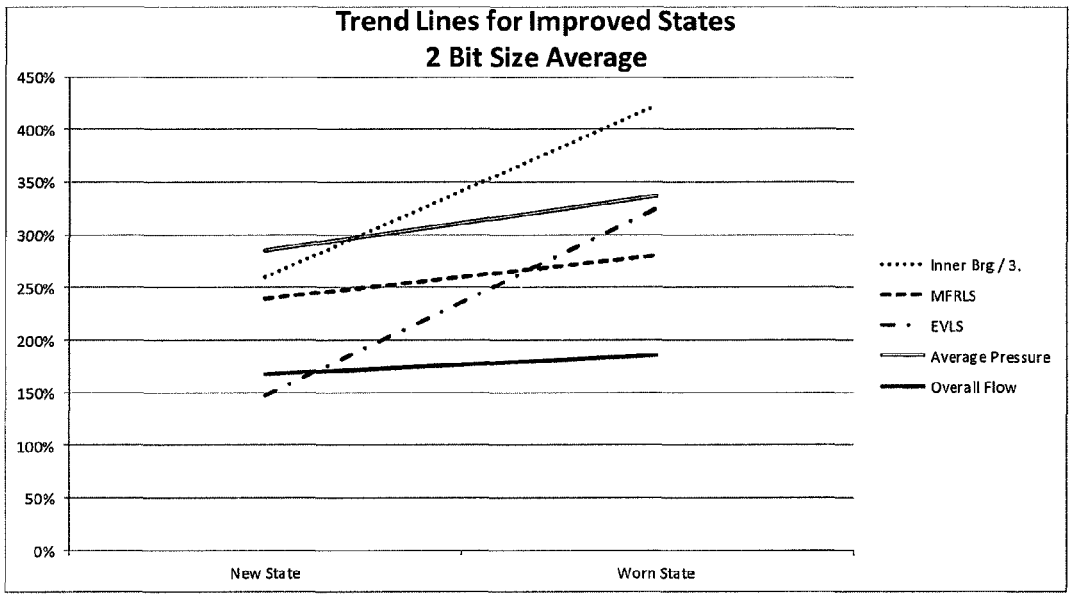
FIGS. 23-35 represent graphs that illustrate improvements in fluid flow throughout bit life according to embodiments of the invention.

Improvements in fluid flow and bit life are detailed in FIGS. 23-32. Along these lines FIG. 23 represents a graph that illustrates improvement of key measurements in two bit sizes when comparing an embodiment of the invention shown in FIG. 21 with respect to a known design shown in FIG. 8 between a new state and a worn state. The measurements are an average of the two sizes analyzed and include overall flow, average pressure, exit velocity on the load side (EVLS), mass flow rate on the load side (MFRLS), and inner bearing fluid flow. As shown in FIG. 23, embodiments of the invention can provide a dramatic improvement in these measurements. FIG. 23 is based on measurements in a new state and a worn state.

Figure 24:
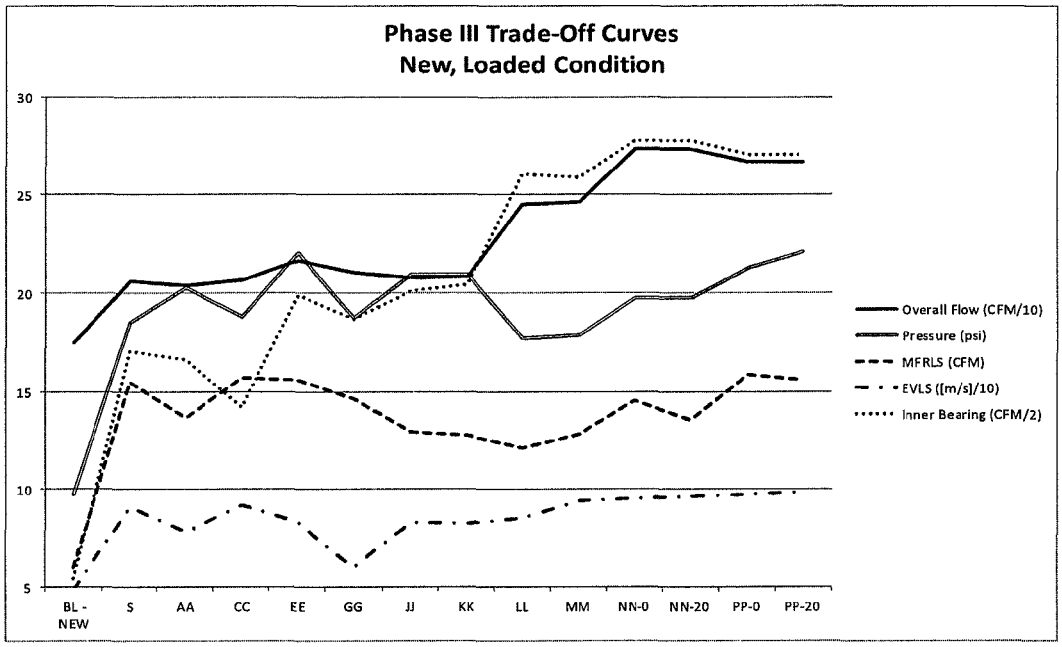
Figure 25:
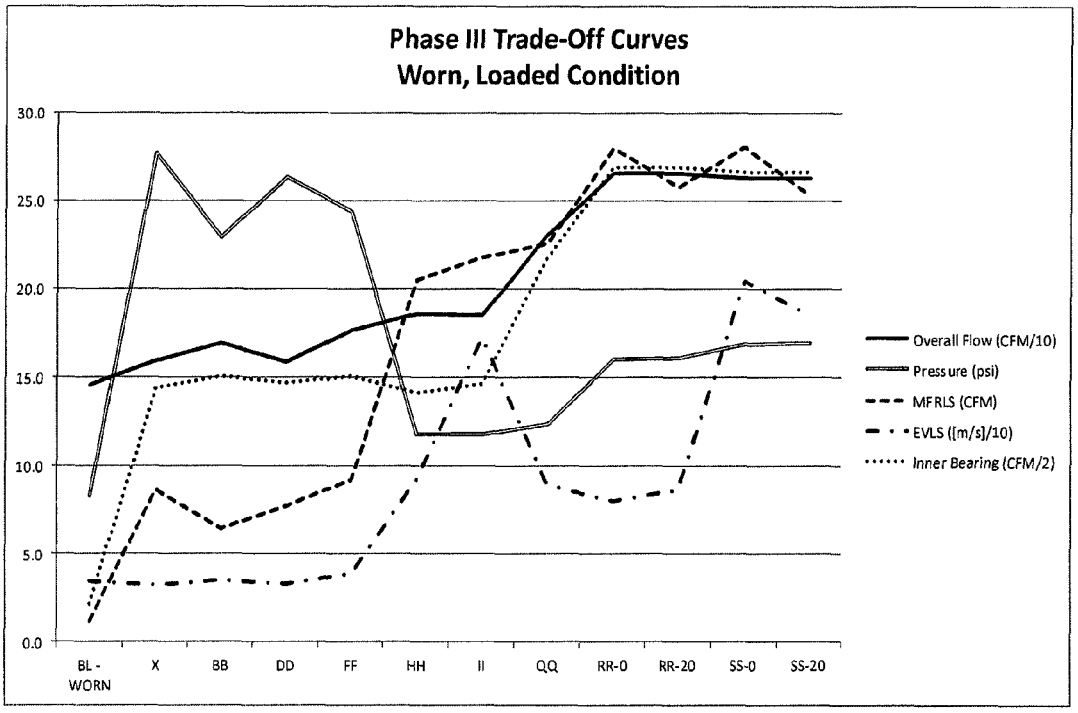

FIG. 24 represents a graph that illustrates progression of the values shown in FIG. 23 throughout the analysis process of the new state. FIG. 25 illustrates is the same progression shown in FIG. 24 but for the worn state.

Figure 26:
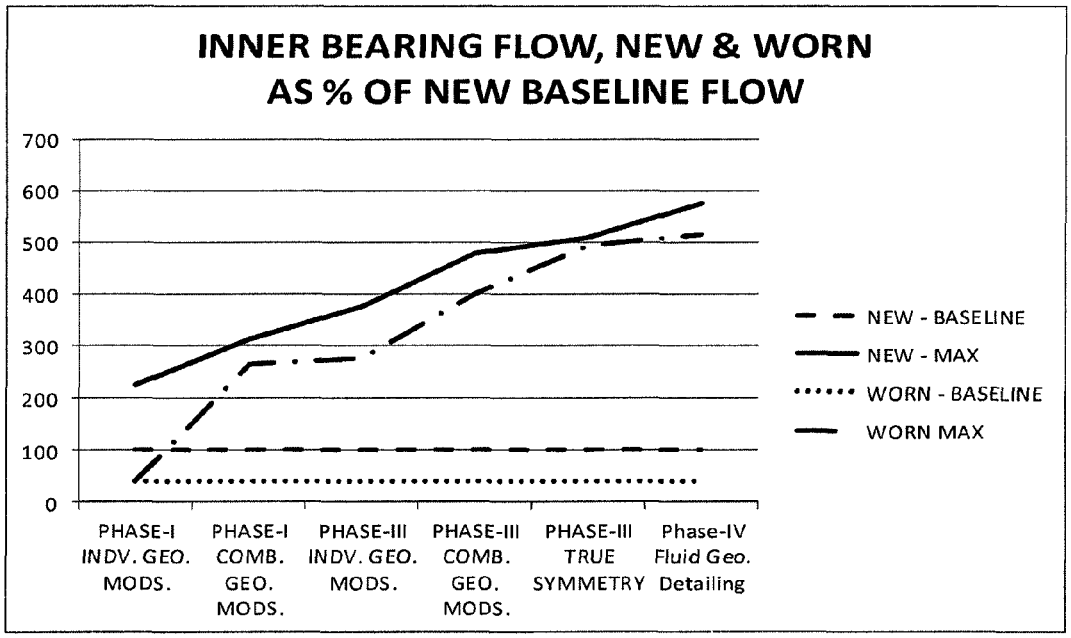
Figure 27:
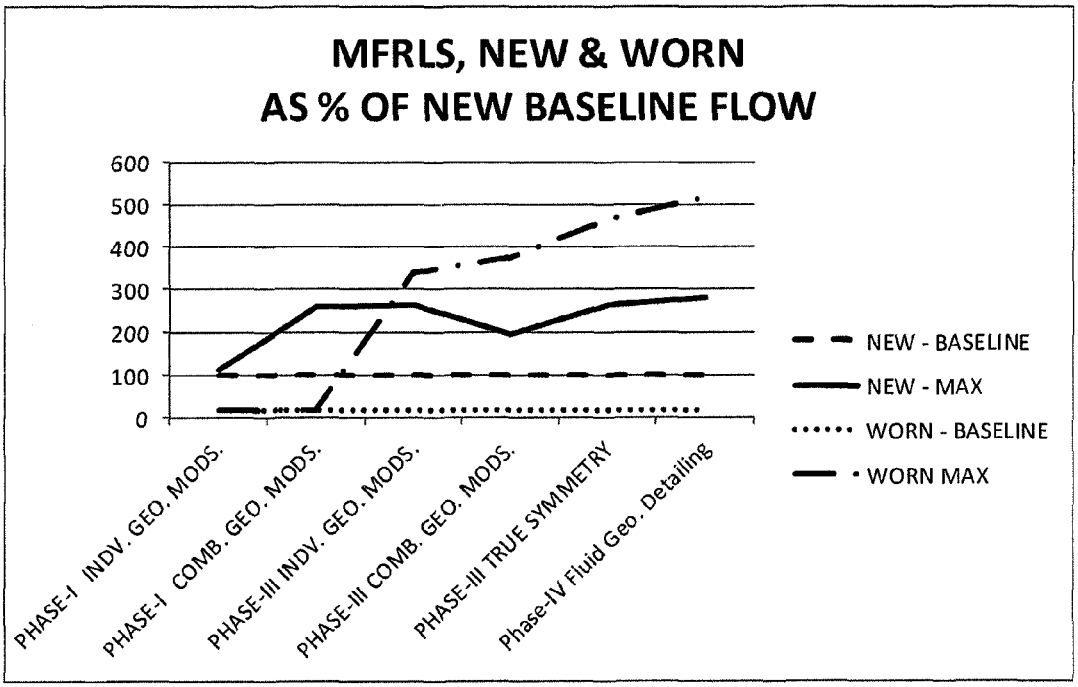
Figure 28:
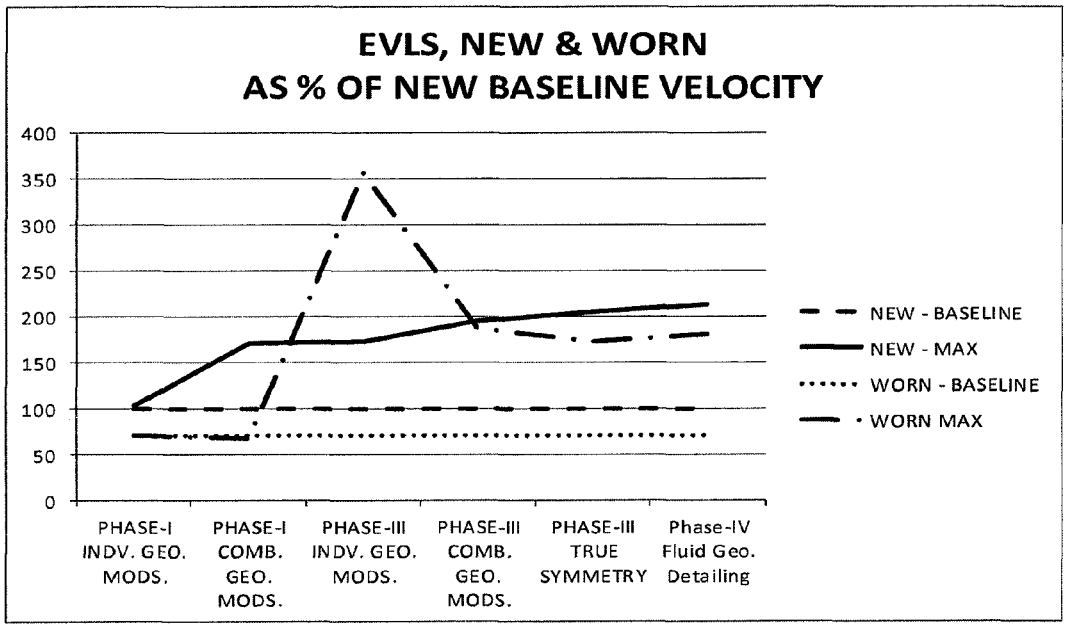

FIGS. 26-28 illustrate improvements in various parameters in new and worn conditions in bit structures including various aspects of embodiments of the invention as compared to known bit design such as shown in FIG. 8. For example, FIG. 26 illustrates improvements in fluid flow at the inner bearing. As shown in FIG. 26, every aspect of the invention can improve bearing flow in a worn condition. Additionally, every aspect of the invention shows improved bearing flow in a new condition with the exception of individual geometry modifications. FIG. 27 illustrates improvements in mass flow rate on the load side and FIG. 28 illustrates improvements in exit velocity on the load side.

The bearing structure and associated fluid flow may be analyzed with respect to quadrants. Along these lines, the structure shown in FIG. 21 may be divided into quadrants FIGS. 29-32 illustrate improvements Analyzing the bit in different quadrants Q1, Q2, Q3, Q4. The quadrants are shifted from horizontal and vertical due to the shifting of the load as the bit rotates. In reality, the load bottom dead center can be shifted from about 5° to about 35° from bottom dead center, depending upon how fast the bit is rotating during service.

Figure 29:
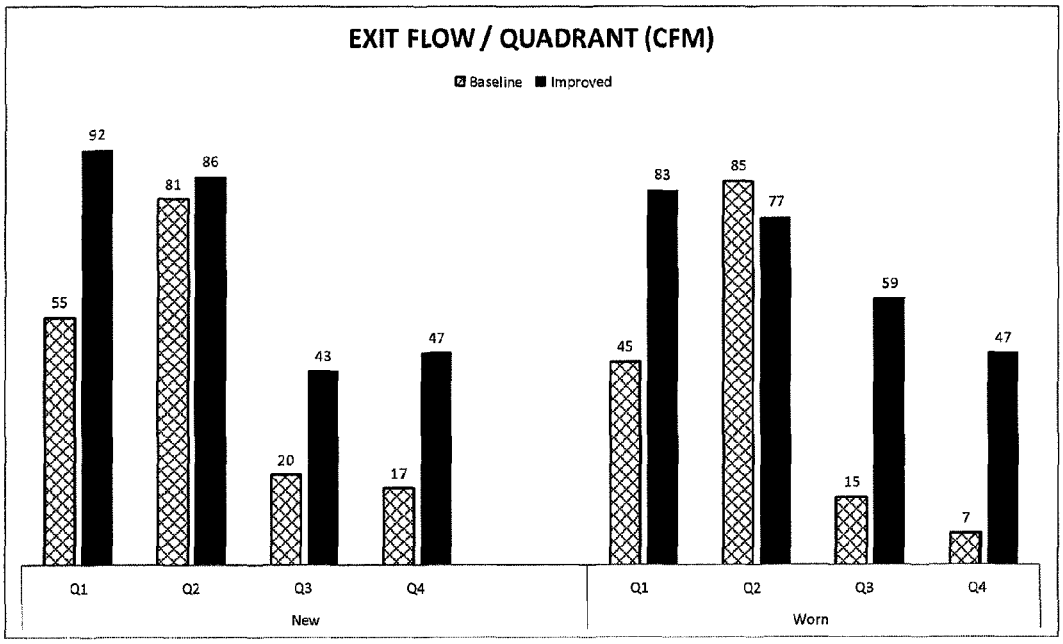
Figure 30:
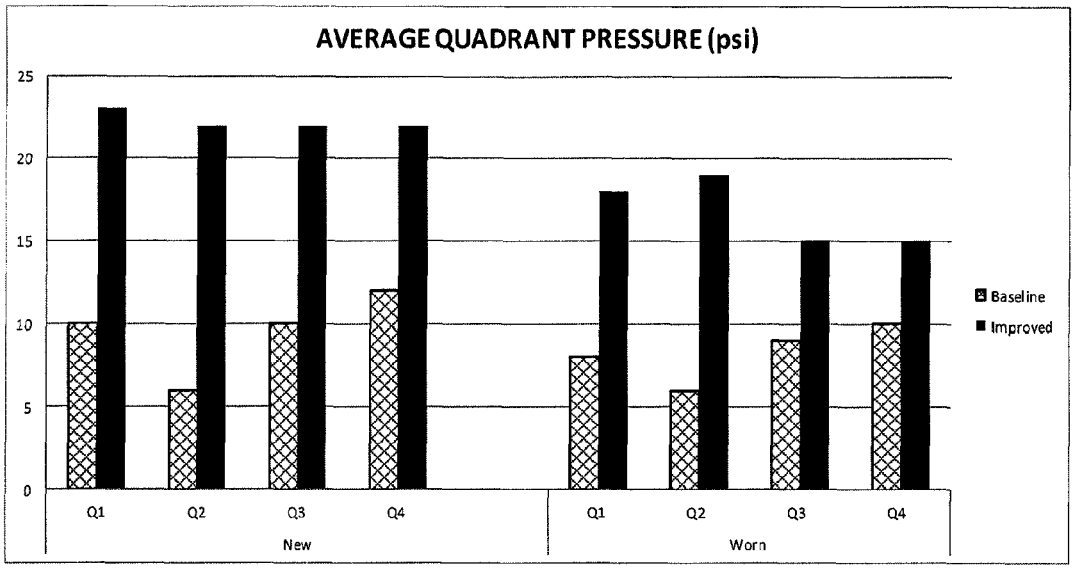

FIGS. 29 and 30 illustrate improvements in exit flow and average pressure between the embodiment shown in FIG. 21 with respect to the known design shown in FIG. 8 in the new and worn states. The only quadrant that did not show improvement was quadrant Q2 in the worn state. This is because the existing design already had most flow directed to quadrant Q2. As can be seen in FIG. 29, all other quadrants had improvement and, quadrants Q3 and Q4 experienced dramatic improvement in air flow in the new and worn conditions. Additionally, as shown in FIG. 30, all quadrants exhibited dramatic improvements in average quadrant pressure as compared to known designs in both the new and worn states.

Symmetrically arranging flow paths can help to ensure that there are no particularly vulnerable areas about the bit where debris can penetrate more easily. In some cases, features may be symmetrically arranged with respect to the right and left sides of the view shown in FIG. 21, such as the small roller race vent holes. However, it may not be possible to arranged features symmetrically with respect to the upper and lower quadrants in the view shown in FIG. 21. For example, a fluid exit slot could not be located in the lower quadrant because that is where the lower leading edge is located. Such an exit would quickly pack with debris or permit debris to enter in the worst area possible with respect to the bearing structure of the bit.

Figure 31:
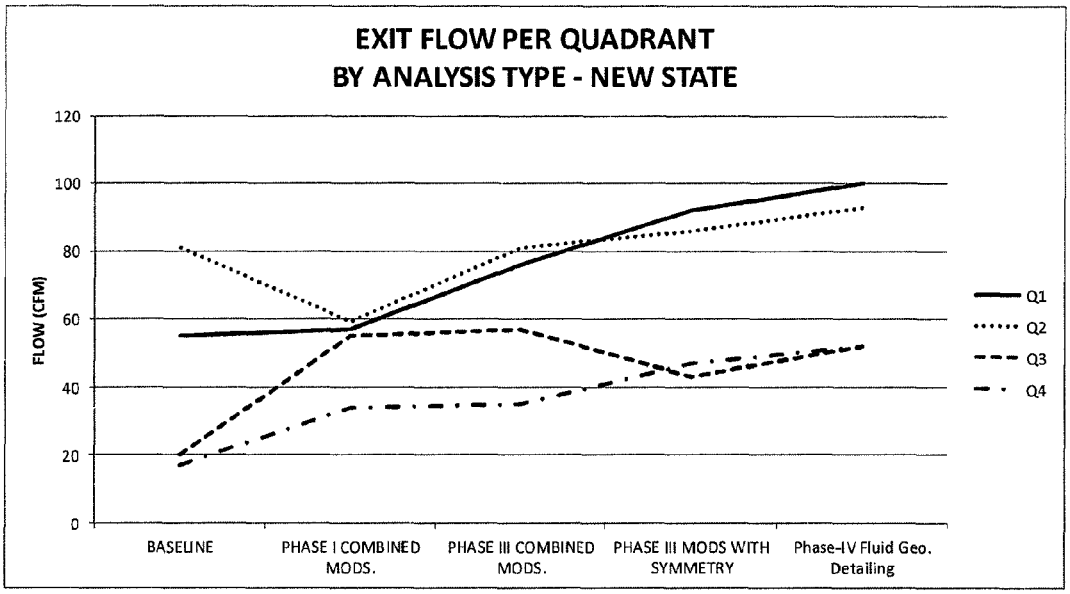
Figure 32:
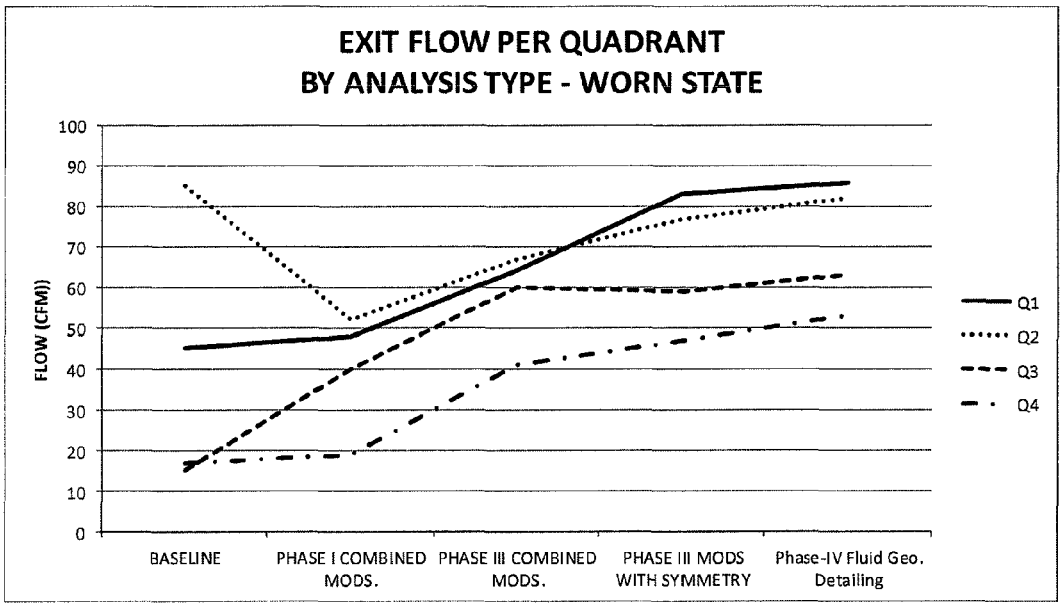
Figure 33:
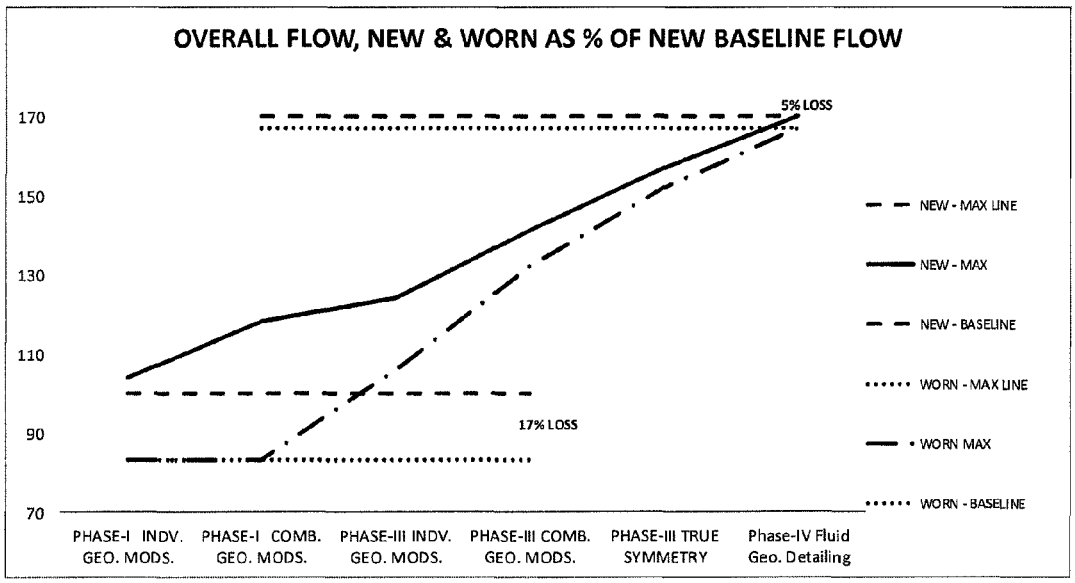

FIGS. 31 and 32 illustrate exit flow in quadrants Q1-Q4 in new and worn conditions comparing different modifications according to embodiments of the invention. FIG. 33 represents a graph that illustrates overall flow as a percentage of baseline flow through the bearing in new and worn states showing the effects of various individual geometry modifications, combined geometry modifications, symmetric geometry modifications and fluid geometry detailing. The phase I and phase III referred to in FIG. 33 relate to computer analysis of the various modifications. Phase II and phase IV related to laboratory verification of the computer analyses.

Figure 34:
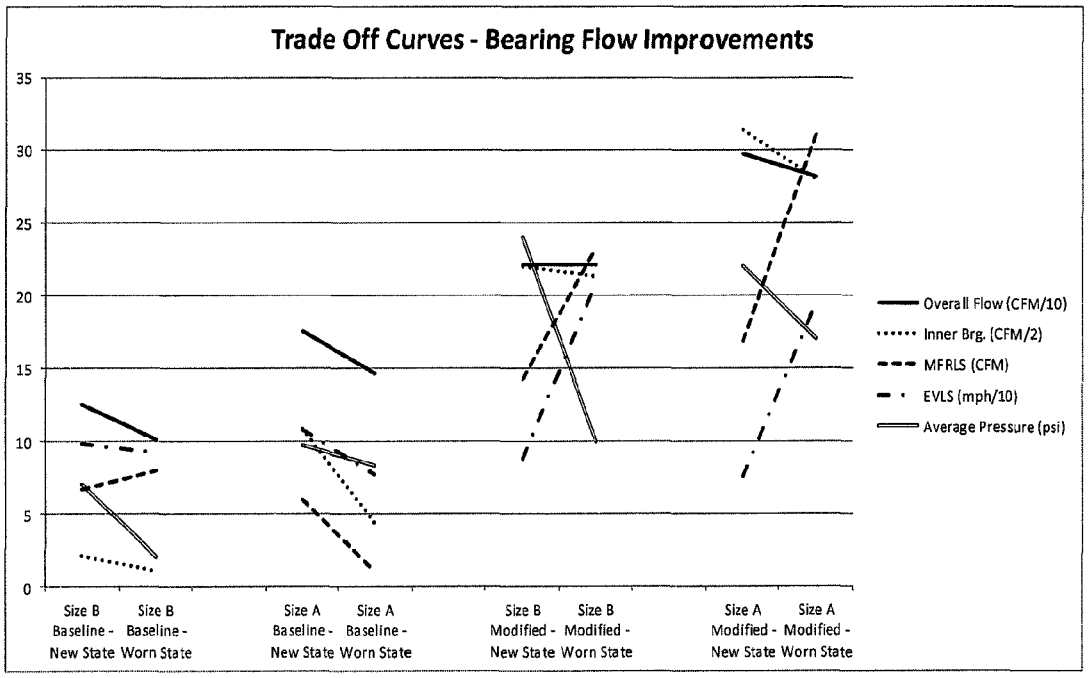
Figure 35:
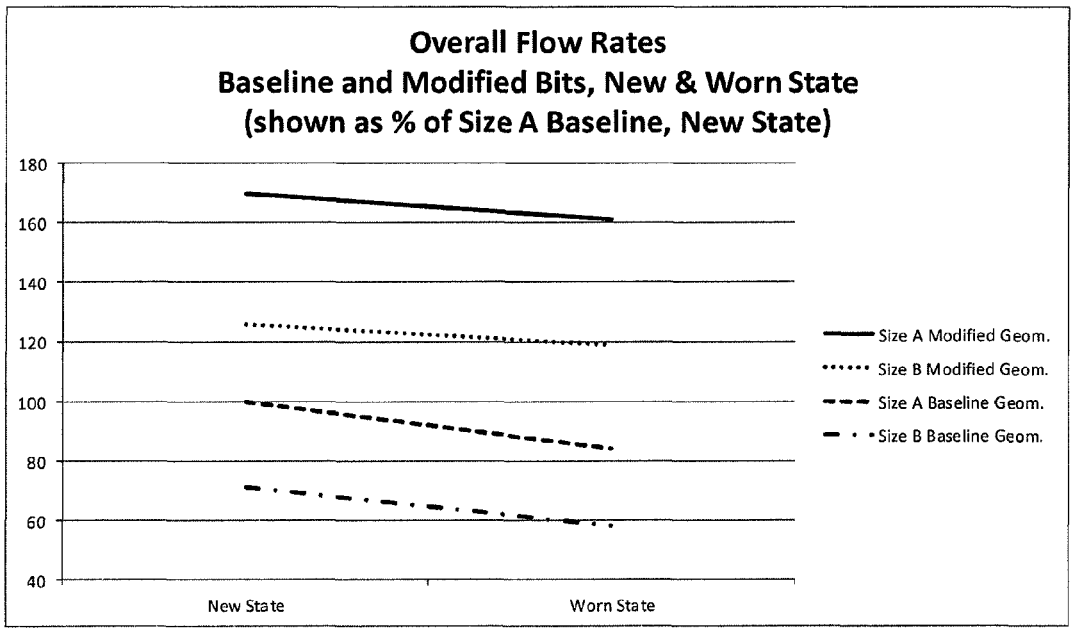

FIG. 34 represent graphs that illustrate differences between various flow parameters for two different sizes of drill bit in a new state and a worn state. FIG. 35 represents a graph that illustrates overall flow rates as a percentage of overall flow in two different sizes of drill bit having known and modified designs in a new state and a worn state.

The invention can includes a method for designing a drill bit. The method can include analyzing flow in a bit's bearing structure. One or more modifications such as those described above can be introduced into the bearing structure. The flow may be analyzed for a bearing including each of the modifications individually and combinations of two or more modifications. The characteristics of the modifications, such as location, size, orientation, position relative to other modifications may be modified. The flow may then be reanalyzed. Multiple iterations of these steps may be carried out to produce a bit design. The interaction of flows created by various modifications may be analyzed to determine whether the flows cancel each other out.

Typically, the design elements are modified such that they do not cancel each other out, but rather work together to create a harmonious flow. Harmonious flow may be achieved from the entry point of the fluid to the exit point of the fluid.

In general, harmonious flow avoids cancelling flows. For example, flows from inlets do not cancel flows from other inlets or flows from outlets and vice versa. Additionally, harmonious flow can be considered to exist when air flows from the pin flange to the exit slots generally in a straight line. Furthermore, harmonious flow can be considered to exist when fluid generally flows outward with respect to the bearing assembly. If harmonious flow exists, fluid generally flows into and out of the bearing evenly. Along these lines, the flow is typically balanced among the quadrants and is as evenly distributed as possible, with the exception that the flow rate at the bottom of the bearing will typically always be lower than the upper regions of the bearing due to the inability to place exits slots on the bottom of the bearing because they would so quickly become filled with debris.

It is also analyzed whether symmetrically arranging design elements will enhance the flow. In some cases, partial symmetry provided the best improvements. Partial symmetry can include symmetry with respect to only one axis, such as the vertical axis. Design elements can be also be adjusted to create flow patterns within the flow, such as swirling patterns or rotating motion as the air moves from inlets to outlets.

Advantages of embodiments of the invention can include increasing flow and bearing life. The flow may be sustainable over the life of the bearing structure to better cool and clean bearings resulting in a longer, sustainable bearing life. Recirculation zones may be reduced to reduce flow restrictions and flow losses. A power washer flow zone as described above may be created. A recirculation zone exists where fluid is not moving outwardly. The power washer flow zone can potentially reverse the slope of the wear rate curve for the inner bearing and the load side of the main roller bearing race. The power washer flow zone can extend the entire axial length of the bearing structure to a "virtual" exit. This can flush cuttings that may migrate to the inner bearing. The power washer flow zone can turn a region of the bit that experienced a highest failure rate into a zone with some of the highest relative flow rates. This can result in the increased flow rates and pressures described above. Embodiments of the invention can also create an air curtain as described above. The air curtain can be important to maintaining as close to 100% debris exclusion as possible. Absence of the air curtain at any point around the perimeter except at an exit slot can be considered a high risk debris entry point. Throughout the development of the invention, computerized analyses were verified and validated by laboratory results using rapid prototype parts.

The foregoing description of the invention illustrates and describes the present invention. Additionally, the disclosure shows and describes only the preferred embodiments of the invention, but as aforementioned, it is to be understood that the invention is capable of use in various other combinations, modifications, and environments and is capable of changes or modifications within the scope of the inventive concept as expressed herein, commensurate with the above teachings, and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

We claim:

1. An air-cooled earth-boring drill bit including a plurality of lugs each having a cone arranged over the lug and a bearing structure including a plurality of roller bearings and ball bearings permitting the cone to rotate with respect to the lug, each lug includes a pin flange at a tip of the lug, a first roller race distal to the pin flange, a plurality of first rollers riding on the first roller race, a thrust flange distal to the first roller race, a ball race distal to the thrust flange, a plurality of ball bearings riding on the ball race, a ball race flange distal to the ball race, a second roller race distal to the ball race flange, a plurality of second rollers riding on the second roller race, and a second roller race flange distal to the second roller race, the drill bit comprising:

at least one pin flange vent slot in a face of the pin flange opposite the first roller race, wherein the at least one pin flange vent slot opens radially outward to an outer edge of the pin flange in a direction of a load side of the bearing structure;

a plurality of second roller race air exit slots distal to the second roller race flange, wherein the second roller race air exit slots are arranged to create an air curtain around a perimeter of the bearing structure; and a plurality of flow passages within the lug to supply fluid to the at least one pin flange vent slot and to the plurality of second roller race air exit slots.

2. The drill bit according to claim 1, further comprising:

at least one thrust flange vent slot in a surface of the thrust flange facing the first rollers, wherein the at least one thrust flange vent slot opens in the direction of the load side of the bearing.

3. The drill bit according to claim 2, wherein the at least one pin flange vent slot and at least one thrust flange vent slot are arranged symmetrically about a plane.

4. The drill bit according to claim 3, wherein the plane passes through a bottom, center of the drill bit, thereby resulting in fluid flowing evenly into and outwards with respect to the bearing structure.

5. The drill bit according to claim 3, wherein the plane is at an angle with respect to a plane that passes through a bottom, center of the drill bit.

6. The drill bit according to claim 2, further comprising:

at least one thrust flange slot in a surface of the thrust flange facing the first rollers; and a first roller race air groove in the surface of the thrust flange facing the first rollers, wherein the at least one thrust flange slot, the at least one thrust flange vent slot and the first roller race air groove extend into the surface of the thrust flange substantially a same distance.

7. The drill bit according to claim 1, further comprising:

at least one first roller race vent hole in the first roller race.

8. The drill bit according to claim 7, wherein the at least one first roller race vent hole is arranged opposite the load side of the bearing.

9. The drill bit according to claim 7, wherein the drill bit comprises two first roller race vent holes arranged opposite the load side of the lug, wherein the vent holes are symmetrically arranged opposite the at least one pin flange vent slot.

10. The drill bit according to claim 1, further comprising:

at least one ball race relief cut arranged in an edge of the ball race flange or in an edge of the thrust flange.

11. The drill bit according to claim 1, further comprising:

at least one second roller race flange air groove arranged on the second roller race flange.

12. The drill bit according to claim 1, wherein side surfaces of the pin flange, thrust flange, and ball race flange are rounded, and wherein surfaces on an interior surface of the cone arranged opposite the side surfaces of the pin flange, thrust flange, and ball race flange are rounded.

13. The drill bit according to claim 1, wherein the at least one pin flange vent slot has a width that increases with increasing distance from a central axis of the lug.

14. The drill bit according to claim 1, wherein an outer edge of the at least one pin flange vent slot includes a chamfer and rounded transitions between the chamfer and surfaces of the at least one pin flange vent slot and a side surface of the pin flange.

15. The drill bit according to claim 1, wherein no surfaces on the lug or an interior surface of the cone meet at a 90° corner.

16. The drill bit according to claim 1, further comprising:

a ball loading passage and a ball loading hole opening in the ball race and configured to permit ball bearings to be introduced into the ball race;

a ball plug configured to be arranged in the ball loading passage, the ball plug comprising a concave lower portion;

a plurality of passages intersecting with the ball loading passage, the passages having a predetermined arrangement and having a predetermined diameter such that no recirculation zones exist in the passages; and a central passage in the lug that is offset relative to the pin flange.

17. The drill bit according to claim 16, wherein the ball loading passage, a ball plug stem, plurality of passages intersecting with the ball loading passage, and central passage in the lug reduces recirculation zones, thereby increasing fluid flow.

18. The drill bit according to claim 17, wherein the plurality of second roller race air exit slots are arranged symmetrically about a plane.

* * * * *